US008162466B2

(12) United States Patent
Bibl et al.

(10) Patent No.: US 8,162,466 B2
(45) Date of Patent: Apr. 24, 2012

(54) PRINTHEAD HAVING IMPEDANCE FEATURES

(75) Inventors: Andreas Bibl, Los Altos, CA (US); John A. Higginson, Santa Clara, CA (US); Paul A. Hoisington, Norwich, VT (US); Deane A. Gardner, Cupertino, CA (US); Robert A. Hasenbein, Enfield, NH (US); Melvin L. Biggs, Norwich, VT (US); Edward R. Moynihan, Plainfield, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 192 days.

(21) Appl. No.: 12/486,693

(22) Filed: Jun. 17, 2009

(65) Prior Publication Data

US 2010/0039479 A1 Feb. 18, 2010

Related U.S. Application Data

(63) Continuation of application No. 11/213,596, filed on Aug. 26, 2005, now abandoned, which is a continuation of application No. 10/189,947, filed on Jul. 3, 2002, now Pat. No. 7,052,117.

(51) Int. Cl.
*B41J 2/17* (2006.01)
*B41J 2/05* (2006.01)
*B41J 2/175* (2006.01)

(52) U.S. Cl. ..... 347/94; 347/65; 347/93

(58) Field of Classification Search ..... 347/65, 347/68–72, 93, 94

See application file for complete search history.

(56) References Cited

U.S. PATENT DOCUMENTS

| | | | |
|---|---|---|---|
| 2,892,107 | A | 6/1959 | Gravley et al. |
| 4,005,440 | A | 1/1977 | Amberntsson |
| 4,051,582 | A | 10/1977 | Eschler et al. |
| 4,106,976 | A | 8/1978 | Chiou et al. |
| 4,158,847 | A | 6/1979 | Heinzl et al. |
| 4,216,477 | A | 8/1980 | Matsuda et al. |
| 4,355,256 | A | 10/1982 | Perduijn et al. |
| 4,480,259 | A | 10/1984 | Kruger et al. |
| 4,504,845 | A | 3/1985 | Kattner et al. |
| 4,528,574 | A | 7/1985 | Boyden |
| 4,620,123 | A | 10/1986 | Farrall et al. |
| 4,627,138 | A | 12/1986 | Im |
| 4,641,153 | A | 2/1987 | Cruz-Uribe |
| 4,665,409 | A | 5/1987 | Behrens et al. |

(Continued)

FOREIGN PATENT DOCUMENTS

DE 100 11 366 A1 1/2001

(Continued)

OTHER PUBLICATIONS

International Search Report, International Application No. PCT/US03/20730, Mar. 25, 2004, pp. 1-2.

(Continued)

*Primary Examiner* — Geoffrey Mruk
(74) *Attorney, Agent, or Firm* — Fish & Richardson P.C.

(57) ABSTRACT

Ink jet printheads and printhead components having a body that include a flow path, a piezoelectric actuator having a piezoelectric layer fixed to the body and an impedance feature in the flow path are described. The impedance feature includes a plurality of posts arranged in a first row, at least one post in the first row of posts having a downstream surface that is concave.

13 Claims, 26 Drawing Sheets

U.S. PATENT DOCUMENTS

| | | | |
|---|---|---|---|
| 4,670,074 | A | 6/1987 | Broussoux et al. |
| 4,672,398 | A | 6/1987 | Kuwabara et al. |
| 4,680,595 | A | 7/1987 | Cruz-Uribe et al. |
| 4,703,333 | A | 10/1987 | Hubbard |
| 4,726,099 | A | 2/1988 | Card et al. |
| 4,728,969 | A | 3/1988 | Le et al. |
| 4,730,197 | A | 3/1988 | Raman et al. |
| 4,774,530 | A | 9/1988 | Hawkins |
| 4,789,425 | A | 12/1988 | Drake et al. |
| 4,812,199 | A | 3/1989 | Sickafus |
| 4,835,554 | A | 5/1989 | Hoisington et al. |
| 4,863,560 | A | 9/1989 | Hawkins |
| 4,899,178 | A | 2/1990 | Tellier |
| 4,966,037 | A | 10/1990 | Sumner et al. |
| 5,000,811 | A | 3/1991 | Campanelli |
| 5,041,190 | A | 8/1991 | Drake et al. |
| 5,096,535 | A | 3/1992 | Hawkins et al. |
| 5,124,717 | A | 6/1992 | Campanelli et al. |
| 5,202,703 | A | 4/1993 | Hoisington et al. |
| 5,204,690 | A | 4/1993 | Lorenze, Jr. et al. |
| 5,227,813 | A | 7/1993 | Pies et al. |
| 5,235,352 | A | 8/1993 | Pies et al. |
| 5,259,737 | A | 11/1993 | Kamisuki et al. |
| 5,265,315 | A | 11/1993 | Hoisington et al. |
| 5,278,585 | A | 1/1994 | Karz et al. |
| 5,374,332 | A | 12/1994 | Koyama et al. |
| 5,376,856 | A | 12/1994 | Takeuchi et al. |
| 5,376,857 | A | 12/1994 | Takeuchi et al. |
| 5,385,635 | A | 1/1995 | O'Neill |
| 5,387,314 | A | 2/1995 | Baughman et al. |
| 5,402,926 | A | 4/1995 | Takeuchi et al. |
| 5,406,682 | A | 4/1995 | Zimnicki et al. |
| 5,408,739 | A | 4/1995 | Altavela et al. |
| 5,414,916 | A | 5/1995 | Hayes |
| 5,430,344 | A | 7/1995 | Takeuchi et al. |
| 5,446,484 | A | 8/1995 | Hoisington et al. |
| 5,459,501 | A | 10/1995 | Lee et al. |
| 5,463,413 | A | 10/1995 | Ho et al. |
| 5,463,414 | A | 10/1995 | Temple et al. |
| 5,475,279 | A | 12/1995 | Takeuchi et al. |
| 5,477,344 | A | 12/1995 | Lubinsky et al. |
| 5,484,507 | A | 1/1996 | Ames |
| 5,489,930 | A | 2/1996 | Anderson |
| 5,500,988 | A | 3/1996 | Moynihan et al. |
| 5,501,893 | A | 3/1996 | Laermer et al. |
| 5,502,471 | A | 3/1996 | Obermeier et al. |
| 5,512,793 | A | 4/1996 | Takeuchi et al. |
| 5,512,922 | A | 4/1996 | Paton |
| 5,518,952 | A | 5/1996 | Vonasek et al. |
| 5,581,286 | A | 12/1996 | Hayes et al. |
| 5,592,042 | A | 1/1997 | Takuchi et al. |
| 5,605,659 | A | 2/1997 | Moynihan et al. |
| 5,617,127 | A | 4/1997 | Takeuchi et al. |
| 5,622,748 | A | 4/1997 | Takeuchi et al. |
| 5,631,040 | A | 5/1997 | Takuchi et al. |
| 5,643,379 | A | 7/1997 | Takeuchi et al. |
| 5,655,538 | A | 8/1997 | Lorraine et al. |
| 5,658,471 | A | 8/1997 | Murthy et al. |
| 5,659,346 | A | 8/1997 | Moynihan |
| 5,665,249 | A | 9/1997 | Burke et al. |
| 5,666,143 | A | 9/1997 | Burke et al. |
| 5,670,999 | A | 9/1997 | Takeuchi et al. |
| 5,691,593 | A | 11/1997 | Takeuchi et al. |
| 5,691,594 | A | 11/1997 | Takeuchi et al. |
| 5,691,752 | A | 11/1997 | Moynihan et al. |
| 5,704,105 | A | 1/1998 | Venkataramani et al. |
| 5,710,584 | A | 1/1998 | Suzuki et al. |
| 5,718,044 | A | 2/1998 | Baughman et al. |
| 5,734,399 | A | 3/1998 | Weber et al. |
| 5,736,993 | A | 4/1998 | Regimbal et al. |
| 5,745,131 | A | 4/1998 | Kneezel et al. |
| 5,752,303 | A | 5/1998 | Thiel et al. |
| 5,757,400 | A | 5/1998 | Hoisington |
| 5,790,156 | A | 8/1998 | Mutton et al. |
| 5,793,394 | A | 8/1998 | Kato |
| 5,818,476 | A | 10/1998 | Mey et al. |
| 5,818,482 | A | 10/1998 | Ohta et al. |
| 5,821,841 | A | 10/1998 | Furlani et al. |
| 5,821,972 | A | 10/1998 | Mey et al. |
| 5,825,385 | A | 10/1998 | Silverbrook |
| 5,834,880 | A | 11/1998 | Venkataramani et al. |
| 5,841,452 | A | 11/1998 | Silverbrook |
| D402,687 | S | 12/1998 | Sabonis |
| 5,850,241 | A | 12/1998 | Silverbrook |
| 5,852,860 | A | 12/1998 | Lorraine et al. |
| 5,855,049 | A | 1/1999 | Corbett, III et al. |
| 5,861,902 | A | 1/1999 | Beerling |
| D405,822 | S | 2/1999 | Sabonis |
| 5,869,387 | A | 2/1999 | Sato et al. |
| 5,870,123 | A | 2/1999 | Lorenze, Jr. et al. |
| 5,870,124 | A | 2/1999 | Silverbrook |
| 5,871,656 | A | 2/1999 | Silverbrook |
| 5,880,759 | A | 3/1999 | Silverbrook |
| 5,889,544 | A | 3/1999 | Mey et al. |
| 5,901,425 | A | 5/1999 | Bibl et al. |
| 5,907,340 | A | 5/1999 | Katakura |
| 5,927,206 | A | 7/1999 | Bacon et al. |
| 5,933,170 | A | 8/1999 | Takeuchi et al. |
| D417,233 | S | 11/1999 | Sabonis |
| 6,012,799 | A | 1/2000 | Silverbrook |
| 6,019,457 | A | 2/2000 | Silverbrook |
| 6,020,905 | A | 2/2000 | Cornell et al. |
| 6,022,101 | A | 2/2000 | Sabonis |
| 6,022,752 | A | 2/2000 | Hirsh et al. |
| 6,030,065 | A | 2/2000 | Fukuhata |
| 6,031,652 | A | 2/2000 | Furlani et al. |
| 6,033,060 | A | 3/2000 | Minami |
| 6,036,874 | A | 3/2000 | Farnaam |
| 6,037,957 | A | 3/2000 | Grande et al. |
| 6,042,219 | A | 3/2000 | Higashino et al. |
| 6,044,646 | A | 4/2000 | Silverbrook |
| 6,045,710 | A | 4/2000 | Silverbrook |
| 6,047,600 | A | 4/2000 | Ottosson |
| 6,047,816 | A | 4/2000 | Moghadam et al. |
| 6,062,681 | A | 5/2000 | Field et al. |
| 6,067,183 | A | 5/2000 | Furlani et al. |
| 6,070,310 | A | 6/2000 | Ito et al. |
| 6,071,750 | A | 6/2000 | Silverbrook |
| 6,071,822 | A | 6/2000 | Donohue et al. |
| 6,087,638 | A | 7/2000 | Silverbrook |
| 6,088,148 | A | 7/2000 | Furlani et al. |
| 6,089,696 | A | 7/2000 | Lubinsky |
| 6,097,406 | A | 8/2000 | Lubinsky et al. |
| 6,108,117 | A | 8/2000 | Furlani et al. |
| 6,109,746 | A | 8/2000 | Jeanmaire et al. |
| 6,126,846 | A | 10/2000 | Silverbrook |
| 6,127,198 | A | 10/2000 | Coleman et al. |
| 6,140,746 | A | 10/2000 | Miyashita et al. |
| 6,143,190 | A | 11/2000 | Yagi et al. |
| 6,143,432 | A | 11/2000 | deRochemont et al. |
| 6,143,470 | A | 11/2000 | Nguyen et al. |
| 6,161,270 | A | 12/2000 | Ghosh et al. |
| 6,176,570 | B1 | 1/2001 | Kishima et al. |
| 6,179,978 | B1 | 1/2001 | Hirsh et al. |
| 6,186,610 | B1 | 2/2001 | Kocher et al. |
| 6,186,618 | B1 | 2/2001 | Usui et al. |
| 6,188,416 | B1 | 2/2001 | Hayes |
| 6,190,931 | B1 | 2/2001 | Silverbrook |
| 6,209,999 | B1 | 4/2001 | Wen et al. |
| 6,213,588 | B1 | 4/2001 | Silverbrook |
| 6,214,192 | B1 | 4/2001 | Hawkins et al. |
| 6,214,244 | B1 | 4/2001 | Silverbrook |
| 6,214,245 | B1 | 4/2001 | Hawkins et al. |
| 6,217,153 | B1 | 4/2001 | Silverbrook |
| 6,217,155 | B1 | 4/2001 | Silverbrook |
| 6,218,083 | B1 | 4/2001 | McCullough et al. |
| 6,220,694 | B1 | 4/2001 | Silverbrook |
| 6,227,653 | B1 | 5/2001 | Silverbrook |
| 6,227,654 | B1 | 5/2001 | Silverbrook |
| 6,228,668 | B1 | 5/2001 | Silverbrook |
| 6,234,608 | B1 | 5/2001 | Genovese et al. |
| 6,234,611 | B1 | 5/2001 | Silverbrook |
| 6,235,211 | B1 | 5/2001 | Silverbrook |
| 6,235,212 | B1 | 5/2001 | Silverbrook |
| 6,238,044 | B1 | 5/2001 | Silverbrook et al. |
| 6,238,115 | B1 | 5/2001 | Silverbrook et al. |
| 6,238,584 | B1 | 5/2001 | Hawkins et al. |

6,239,821 B1 5/2001 Silverbrook
6,241,342 B1 6/2001 Silverbrook
6,241,904 B1 6/2001 Silverbrook
6,241,905 B1 6/2001 Silverbrook
6,241,906 B1 6/2001 Silverbrook
6,244,691 B1 6/2001 Silverbrook
6,245,246 B1 6/2001 Silverbrook
6,245,247 B1 6/2001 Silverbrook
6,247,790 B1 6/2001 Silverbrook
6,247,791 B1 6/2001 Silverbrook
6,247,793 B1 6/2001 Silverbrook
6,247,794 B1 6/2001 Silverbrook
6,247,795 B1 6/2001 Silverbrook
6,247,796 B1 6/2001 Silverbrook
6,248,248 B1 6/2001 Silverbrook
6,248,249 B1 6/2001 Silverbrook
6,248,505 B1 6/2001 McCullough et al.
6,251,298 B1 6/2001 Silverbrook
6,252,697 B1 6/2001 Hawkins et al.
6,254,793 B1 7/2001 Silverbrook
6,255,762 B1 7/2001 Sakamaki et al.
6,256,849 B1 7/2001 Kim
6,258,284 B1 7/2001 Silverbrook
6,258,285 B1 7/2001 Silverbrook
6,258,286 B1 7/2001 Hawkins et al.
6,260,953 B1 7/2001 Silverbrook
6,263,551 B1 7/2001 Lorraine et al.
6,264,306 B1 7/2001 Silverbrook
6,264,307 B1 7/2001 Silverbrook
6,264,849 B1 7/2001 Silverbrook
6,267,905 B1 7/2001 Silverbrook
6,273,552 B1 8/2001 Hawkins et al.
6,274,056 B1 8/2001 Silverbrook
6,276,774 B1 8/2001 Moghadam et al.
6,276,782 B1 8/2001 Sharma et al.
6,280,643 B1 8/2001 Silverbrook
6,281,912 B1 8/2001 Silverbrook
6,283,575 B1 9/2001 Hawkins et al.
6,286,935 B1 9/2001 Silverbrook
6,290,317 B1 9/2001 Hotomi
6,291,317 B1 9/2001 Salatino et al.
6,293,658 B1 9/2001 Silverbrook
6,294,101 B1 9/2001 Silverbrook
6,296,346 B1 10/2001 Seo et al.
6,299,289 B1 10/2001 Silverbrook
6,299,300 B1 10/2001 Silverbrook
6,299,786 B1 10/2001 Silverbrook
6,303,042 B1 10/2001 Hawkins et al.
6,305,788 B1 10/2001 Silverbrook
6,305,791 B1 10/2001 Hotomi et al.
6,306,671 B1 10/2001 Silverbrook
6,309,048 B1 10/2001 Silverbrook
6,309,054 B1 10/2001 Kawamura et al.
6,312,114 B1 11/2001 Silverbrook
6,312,615 B1 11/2001 Silverbrook
6,315,399 B1 11/2001 Silverbrook
6,315,914 B1 11/2001 Silverbrook
6,318,849 B1 11/2001 Silverbrook
6,322,194 B1 11/2001 Silverbrook
6,322,195 B1 11/2001 Silverbrook
6,328,399 B1 12/2001 Wen
6,328,417 B1 12/2001 Silverbrook
6,328,425 B1 12/2001 Silverbrook
6,328,431 B1 12/2001 Silverbrook
6,331,258 B1 12/2001 Silverbrook
6,336,715 B1 1/2002 Hotomi et al.
6,338,548 B1 1/2002 Silverbrook
6,340,222 B1 1/2002 Silverbrook
6,345,424 B1 2/2002 Hasegawa
6,350,019 B1 2/2002 Shingai et al.
6,352,337 B1 3/2002 Sharma
6,352,814 B1 3/2002 McCullough et al.
6,364,459 B1 4/2002 Sharma et al.
6,371,598 B1 4/2002 Fujii et al.
6,378,989 B1 4/2002 Silverbrook
6,378,996 B1 4/2002 Shimada et al.
6,382,767 B1 5/2002 Greive
6,382,779 B1 5/2002 Silverbrook
6,382,782 B1 5/2002 Anagnostopoulos et al.
6,383,833 B1 5/2002 Silverbrook
6,386,679 B1 5/2002 Yang et al.
6,393,980 B2 5/2002 Simons
6,394,581 B1 5/2002 Silverbrook
6,398,344 B1 6/2002 Silverbrook
6,398,348 B1 6/2002 Haluzak et al.
6,402,282 B1 6/2002 Webb
6,402,300 B1 6/2002 Silverbrook
6,402,303 B1 6/2002 Sumi
6,406,129 B1 6/2002 Silverbrook
6,406,607 B1 6/2002 Hirsh et al.
6,409,316 B1 6/2002 Clark et al.
6,409,323 B1 6/2002 Silverbrook
6,412,908 B2 7/2002 Silverbrook
6,412,912 B2 7/2002 Silverbrook
6,412,914 B1 7/2002 Silverbrook
6,413,700 B1 7/2002 Hallman
6,416,168 B1 7/2002 Silverbrook
6,416,932 B1 7/2002 Ray et al.
6,420,196 B1 7/2002 Silverbrook
6,422,677 B1 7/2002 Deshpande et al.
6,425,651 B1 7/2002 Silverbrook
6,425,661 B1 7/2002 Silverbrook et al.
6,425,971 B1 7/2002 Silverbrook
6,428,133 B1 8/2002 Silverbrook
6,428,134 B1 8/2002 Clark et al.
6,428,146 B1 8/2002 Sharma et al.
6,428,147 B2 8/2002 Silverbrook
6,428,151 B1 * 8/2002 Yi et al. ..... 347/68
6,439,695 B2 8/2002 Silverbrook
6,439,699 B1 8/2002 Silverbrook
6,439,701 B1 8/2002 Taneya et al.
6,439,703 B1 8/2002 Anagnostopoulos et al.
6,439,704 B1 8/2002 Silverbrook
6,450,615 B2 9/2002 Kojima et al.
6,450,619 B1 9/2002 Anagnostopoulos et al.
6,450,627 B1 9/2002 Moynihan et al.
6,450,628 B1 9/2002 Jeanmaire et al.
6,451,216 B1 9/2002 Silverbrook
6,453,526 B2 9/2002 Lorraine et al.
6,454,396 B2 9/2002 Silverbrook
6,457,795 B1 10/2002 Silverbrook
6,457,807 B1 10/2002 Hawkins et al.
6,460,778 B1 10/2002 Silverbrook
6,463,656 B1 10/2002 Debesis et al.
6,467,885 B2 10/2002 Tanaka
6,471,336 B2 10/2002 Silverbrook
6,474,781 B1 11/2002 Jeanmaire
6,474,789 B1 11/2002 Ishinaga et al.
6,474,794 B1 11/2002 Anagnostopoulos et al.
6,474,795 B1 11/2002 Lebens et al.
6,481,835 B2 11/2002 Hawkins et al.
6,485,130 B2 11/2002 DeLouise et al.
6,488,361 B2 12/2002 Silverbrook
6,488,367 B1 12/2002 Debesis et al.
6,491,362 B1 12/2002 Jeanmaire
6,491,376 B2 12/2002 Trauernicht et al.
6,491,385 B2 12/2002 Anagnostopoulos et al.
6,491,833 B1 12/2002 Silverbrook
6,494,566 B1 12/2002 Kishino et al.
6,497,019 B1 12/2002 Yun
6,502,306 B2 1/2003 Silverbrook
6,502,925 B2 1/2003 Anagnostopoulos et al.
6,503,408 B2 1/2003 Silverbrook
6,505,922 B2 1/2003 Hawkins et al.
6,507,099 B1 1/2003 Silverbrook
6,508,532 B1 1/2003 Hawkins et al.
6,508,543 B2 1/2003 Hawkins et al.
6,508,947 B2 1/2003 Gulvin et al.
6,513,903 B2 2/2003 Sharma et al.
6,513,908 B2 2/2003 Silverbrook
6,521,513 B1 2/2003 Lebens et al.
6,526,658 B1 3/2003 Silverbrook
6,527,357 B2 3/2003 Sharma et al.
6,527,365 B1 3/2003 Silverbrook
6,530,653 B2 3/2003 Le et al.
6,533,390 B1 3/2003 Silverbrook
6,536,874 B1 3/2003 Silverbrook
6,536,883 B2 3/2003 Hawkins et al.

| | | | |
|---|---|---|---|
| 6,537,735 | B1 | 3/2003 | McCullough et al. |
| 6,540,319 | B1 | 4/2003 | Silverbrook |
| 6,540,332 | B2 | 4/2003 | Silverbrook |
| 6,546,628 | B2 | 4/2003 | Silverbrook |
| 6,547,364 | B2 | 4/2003 | Silverbrook |
| 6,547,371 | B2 | 4/2003 | Silverbrook |
| 6,550,895 | B1 | 4/2003 | Silverbrook |
| 6,553,651 | B2 | 4/2003 | Reznick et al. |
| 6,554,410 | B2 | 4/2003 | Jeanmaire et al. |
| 6,557,967 | B1 | 5/2003 | Lee |
| 6,557,978 | B2 | 5/2003 | Silverbrook |
| 6,561,625 | B2 | 5/2003 | Maeng et al. |
| 6,565,193 | B1 | 5/2003 | Silverbrook et al. |
| 6,565,762 | B1 | 5/2003 | Silverbrook |
| 6,566,858 | B1 | 5/2003 | Silverbrook et al. |
| 6,568,797 | B2 | 5/2003 | Yamauchi et al. |
| 6,569,343 | B1 | 5/2003 | Suzuki et al. |
| 6,572,215 | B2 | 6/2003 | Sharma |
| 6,572,715 | B2 | 6/2003 | Komine et al. |
| 6,575,549 | B1 | 6/2003 | Silverbrook |
| 6,578,245 | B1 | 6/2003 | Chatterjee et al. |
| 6,581,258 | B2 | 6/2003 | Yoneda et al. |
| 6,582,059 | B2 | 6/2003 | Silverbrook |
| 6,588,882 | B2 | 7/2003 | Silverbrook |
| 6,588,884 | B1 | 7/2003 | Furlani et al. |
| 6,588,888 | B2 | 7/2003 | Jeanmaire et al. |
| 6,588,889 | B2 | 7/2003 | Jeanmaire |
| 6,588,890 | B1 | 7/2003 | Furlani et al. |
| 6,588,952 | B1 | 7/2003 | Silverbrook et al. |
| 6,594,898 | B1 | 7/2003 | Yun |
| 6,595,617 | B2 | 7/2003 | Sharma et al. |
| 6,599,757 | B1 | 7/2003 | Murai |
| 6,629,756 | B2 | 10/2003 | Wang |
| 6,641,744 | B1 | 11/2003 | Kawamura et al. |
| 6,755,511 | B1 | 6/2004 | Moynihan et al. |
| 6,767,085 | B2 | 7/2004 | Murai |
| 6,880,920 | B2 * | 4/2005 | Murai ..... 347/70 |
| 2001/0001458 | A1 | 5/2001 | Hashizume et al. |
| 2001/0002135 | A1 | 5/2001 | Milligan et al. |
| 2001/0015001 | A1 | 8/2001 | Hashizume et al. |
| 2001/0023523 | A1 | 9/2001 | Kubby et al. |
| 2001/0028378 | A1 | 10/2001 | Lee et al. |
| 2001/0032382 | A1 | 10/2001 | Lorraine et al. |
| 2001/0033313 | A1 | 10/2001 | Ohno et al. |
| 2001/0038404 | A1 | 11/2001 | Kitahara et al. |
| 2002/0008738 | A1 | 1/2002 | Lee et al. |
| 2002/0018105 | A1 | 2/2002 | Usui et al. |
| 2002/0051039 | A1 | 5/2002 | Moynihan et al. |
| 2002/0051042 | A1 | 5/2002 | Takagi et al. |
| 2002/0060724 | A1 | 5/2002 | Le et al. |
| 2002/0075360 | A1 | 6/2002 | Maeng et al. |
| 2002/0085065 | A1 | 7/2002 | Shimada et al. |
| 2002/0096488 | A1 | 7/2002 | Gulvin et al. |
| 2002/0096489 | A1 | 7/2002 | Lee et al. |
| 2002/0097303 | A1 | 7/2002 | Gulvin et al. |
| 2002/0109192 | A1 | 8/2002 | Hogyoku |
| 2002/0122100 | A1 | 9/2002 | Nordstrom et al. |
| 2002/0129478 | A1 | 9/2002 | Kishima |
| 2002/0139235 | A1 | 10/2002 | Nordin et al. |
| 2002/0184907 | A1 | 12/2002 | Vaiyapuri et al. |
| 2003/0016272 | A1 | 1/2003 | Anagnostopoulos et al. |
| 2003/0058309 | A1 | 3/2003 | Haluzak et al. |
| 2003/0081073 | A1 | 5/2003 | Chen et al. |
| 2003/0107622 | A1 | 6/2003 | Sugahara |
| 2003/0131475 | A1 | 7/2003 | Conta |
| 2003/0132823 | A1 | 7/2003 | Hyman et al. |
| 2003/0136002 | A1 | 7/2003 | Nishikawa et al. |
| 2003/0156158 | A1 | 8/2003 | Hirota et al. |
| 2003/0156159 | A1 | 8/2003 | Kobayashi |
| 2003/0156162 | A1 | 8/2003 | Hirota et al. |
| 2004/0004649 | A1 | 1/2004 | Bibl et al. |

FOREIGN PATENT DOCUMENTS

| | | | |
|---|---|---|---|
| EP | 0413340 | A1 | 2/1991 |
| EP | 0709200 | A1 | 5/1996 |
| EP | 0736915 | A1 | 10/1996 |
| EP | 0 755 793 | | 1/1997 |
| EP | 0916500 | A2 | 5/1999 |
| EP | 0949079 | A1 | 10/1999 |
| EP | 0969530 | A2 | 1/2000 |
| EP | 0980103 | A2 | 2/2000 |
| EP | 0867289 | | 3/2000 |
| EP | 0985534 | A1 | 3/2000 |
| EP | 1138492 | A1 | 10/2001 |
| EP | 0963296 | | 1/2002 |
| EP | 1241009 | A2 | 9/2002 |
| EP | 1284188 | A2 | 2/2003 |
| EP | 1321294 | A2 | 6/2003 |
| EP | 1116591 | | 5/2006 |
| JP | 56-105968 | | 8/1981 |
| JP | 57-093160 | | 6/1982 |
| JP | 60-204352 | | 10/1985 |
| JP | 2002-079668 | | 3/1990 |
| JP | 2002-080252 | | 3/1990 |
| JP | 02-184447 | | 7/1990 |
| JP | 2002-173375 | | 7/1990 |
| JP | 03-295657 | | 12/1991 |
| JP | 06-132756 | | 5/1994 |
| JP | 61-37438 | | 5/1994 |
| JP | 06-198876 | | 7/1994 |
| JP | 06-305141 | | 11/1994 |
| JP | 6-312506 | | 11/1994 |
| JP | 06-312506 | | 11/1994 |
| JP | 07-125209 | | 5/1995 |
| JP | 07-205421 | | 8/1995 |
| JP | 08-001952 | | 1/1996 |
| JP | 08-174820 | | 7/1996 |
| JP | 9-39232 | | 2/1997 |
| JP | 09-039234 | | 2/1997 |
| JP | 09-039238 | | 2/1997 |
| JP | 9-150508 | | 6/1997 |
| JP | 09-223831 | | 8/1997 |
| JP | 10264385 | | 10/1998 |
| JP | 11-058737 | | 3/1999 |
| JP | 11-334088 | | 12/1999 |
| JP | 2000-299510 | | 10/2000 |
| JP | 2001010040 | | 1/2001 |
| JP | 2001-058404 | | 3/2001 |
| JP | 2001-071510 | | 3/2001 |
| JP | 2001-088294 | | 4/2001 |
| JP | 2001-260355 | | 9/2001 |
| JP | 2001-334674 | | 12/2001 |
| JP | 2001-341306 | | 12/2001 |
| JP | 2002-059549 | | 2/2002 |
| JP | 2002-103618 | | 4/2002 |
| JP | 2002-185011 | | 6/2002 |
| JP | 2002-187271 | | 7/2002 |
| KR | 2000-0060756 | | 10/2000 |
| WO | WO00/21755 | | 10/1999 |
| WO | WO 00/45445 | | 8/2000 |

OTHER PUBLICATIONS

Partial International Search Report, International Application No. PCT/US03/20730, Oct. 20, 2003, (Annex to Invitation to Pay Additional Fees).

Abstract U.S. Appl. No. 08/884,244.

Abstract U.S. Appl. No. 08/808,608.

Bibl et al., U.S. Appl. No. 11/213,596, filed Aug. 26, 2005, entitled "Printhead", 60 pp.

International Preliminary Report on Patentability, International Application Serial No. PCT/US03/20730, Jul. 27, 2005, 5 pp.

Notice of Reasons for Rejection, Jul. 3, 2009, Japanese Patent Office (office action issued in co-pending Japanese application No. 2007-250120).

Notice of Reasons for Rejection, May 15, 2009, Japanese Patent Office (office action issued in co-pending Japanese application No. 2004-519728).

Communication Pursuant to Article 94(3) EPC, Mar. 11, 2009, European Patent Office (office action issued in co-pending European application No. 03763081.1).

Kim, Notice to File a Response, Mar. 17, 2009, Korean Intellectual Property Office (office action issued in co-pending Korean application No. 2007-7021241).

First Office Action, Jun. 19, 2009, Chinese Patent Office (office action issued in co-pending Chinese application No. 200710161961.0).

Notice of Reasons for Rejection, Feb. 2, 2011, Japanese Patent Office (office action issued in co-pending Japanese Application No. 2009-275001).
Machine Language Translation of JP 09-039232.
Machine Language Translation of JP 10-264385.
USPTO Non-Final Office Action in U.S. Appl. No. 10/962,378, mailed Dec. 20, 2007, 14 pages.
Office action issued in co-pending Korean application No. 10-2010-7007415 dated Jul. 7, 2010, 10 pgs.
Office action issued in co-pending Australian application No. 2008229768 dated Aug. 6, 2010, 2 pgs.
Search Report issued in European application No. 11158973.5 dated Jun. 7, 2011, 8 pgs.
Office Action from corresponding Korean Application No. 10-2010-7007415, mailed May 26, 2011, 4 pages.

* cited by examiner

PRINTHEAD HAVING IMPEDANCE FEATURES

CROSS-REFERENCE TO RELATED APPLICATIONS

This application is a continuation application and claims the benefit of priority under 35 U.S.C. Section 120 of U.S. application Ser. No. 11/213,596, filed on Aug. 26, 2005, which is a continuation of U.S. application Ser. No. 10/189,947, filed on Jul. 3, 2002, now U.S. Pat. No. 7,052,117. The disclosure of each prior application is considered part of and is incorporated by reference in the disclosure of this application.

BACKGROUND

This invention relates to printheads. Ink jet printers typically include an ink path from an ink supply to a nozzle path. The nozzle path terminates in a nozzle opening from which ink drops are ejected. Ink drop ejection is controlled by pressurizing ink in the ink path with an actuator, which may be, for example, a piezoelectric deflector, a thermal bubble jet generator, or an electro statically deflected element. A typical printhead has an array of ink paths with corresponding nozzle openings and associated actuators, and drop ejection from each nozzle opening can be independently controlled. In a drop-on-demand printhead, each actuator is fired to selectively eject a drop at a specific pixel location of an image as the printhead and a printing substrate are moved relative to one another. In high performance printheads, the nozzle openings typically have a diameter of 50 micron or less, e.g. around 25 microns, are separated at a pitch of 100-300 nozzles/inch, have a resolution of 100 to 3000 dpi or more, and provide drop sizes of about 1 to 70 picoliters (pl) or less. Drop ejection frequency is typically 10 kHz or more.

Hoisington et al. U.S. Pat. No. 5,265,315, the entire contents of which is hereby incorporated by reference, describes a printhead that has a semiconductor printhead body and a piezoelectric actuator. The printhead body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path.

The amount of bending that a piezoelectric material exhibits for a given voltage is inversely proportional to the thickness of the material. As a result, as the thickness of the piezoelectric layer increases, the voltage requirement increases. To limit the voltage requirement for a given drop size, the deflecting wall area of the piezoelectric material may be increased. The large piezoelectric wall area may also require a correspondingly large pumping chamber, which can complicate design aspects such as maintenance of small orifice spacing for high-resolution printing.

Printing accuracy is influenced by a number of factors, including the size and velocity uniformity of drops ejected by the nozzles in the head and among multiple heads in a printer. The drop size and drop velocity uniformity are in turn influenced by factors such as the dimensional uniformity of the ink paths, acoustic interference effects, contamination in the ink flow paths, and the actuation uniformity of the actuators.

SUMMARY

In an aspect, the invention features a printhead having a monolithic semiconductor body with an upper face and a lower face. The body defines a fluid path including a pumping chamber, a nozzle flow path, and a nozzle opening. The nozzle opening is defined in the lower face of the body and the nozzle flow path includes an accelerator region. A piezoelectric actuator is associated with the pumping chamber. The actuator includes a piezoelectric layer having a thickness of about 50 micron or less.

In another aspect, the invention features a printhead having a monolithic semiconductor body with a buried layer and an upper face and a lower face. The body defines a plurality of fluid paths. Each fluid path includes a pumping chamber, a nozzle opening, and a nozzle path between the pumping chamber and the nozzle opening. The nozzle path includes an accelerator region. The pumping chamber is defined in the upper face of the body, the nozzle opening is defined in the lower face of the body, and the accelerator region is defined between the nozzle opening and the buried layer. A piezoelectric actuator is associated with the pumping chamber. The actuator includes a layer of piezoelectric material having a thickness of about 25 micron or less.

In another aspect, the invention features a printhead including a monolithic semiconductor body having an upper face and a substantially parallel lower face, the body defining a fluid path including an ink supply path, a pumping chamber, and a nozzle opening, wherein the pumping chamber is defined in the upper face and the nozzle opening is defined in the lower face.

In another aspect, the invention features a printhead with a semiconductor body defining a fluid flow path, a nozzle opening, and a filter/impedance feature having a plurality of flow openings. The cross-section of the flow openings is less than the cross section of the nozzle opening and the sum of the areas of the flow openings is greater than the area of the nozzle opening.

In another aspect, the invention features a printhead including a monolithic semiconductor body defining a flow path and a filter/impedance feature. In embodiments, a nozzle plate defining nozzle openings is attached to the semiconductor body. In embodiments, the semiconductor body defines nozzle openings.

In another aspect, the invention features a filter/impedance feature including a semiconductor having a plurality of flow openings. In embodiments, the cross-section of the openings is about 25 microns or less.

In another aspect, the invention features a printhead including a body with a flow path and a piezoelectric actuator having a pre-fired piezoelectric layer in communication with the flow path and having a thickness of about 50 micron or less.

In another aspect, the invention features a printhead with a piezoelectric layer having a surface $R_a$ of about 0.05 microns or less.

In another aspect, the invention features a printhead having a piezoelectric actuator including a piezoelectric layer having a thickness of about 50 micron or less and having at least one surface thereof including a void-filler material.

In another aspect, the invention features a method of printing, including providing a printhead including a filter/impedance feature having a plurality of flow openings, and ejecting fluid such that t/(flow development time) is about 0.2 or greater, where t is the fire pulse width and the flow development time is (fluid density) $r^2$/(fluid viscosity), where r=cross-section dimension of at least one of the flow openings.

In another aspect, the invention features a method including providing a piezoelectric layer having a thickness of about 50 micron or less, providing a layer of filler material on at least one surface of the layer, reducing the thickness of the filler layer to expose the piezoelectric material, leaving voids in the surface of piezoelectric material including the filler material.

In another aspect, the invention features a method of forming a printhead by providing a body, attaching to the body a piezoelectric layer, reducing the thickness of said fixed piezoelectric layer to about 50 micron or less and utilizing the piezoelectric layer to pressurize fluid in the printhead.

In another aspect, the invention features a method of forming a printhead, including providing a piezoelectric layer, providing a membrane, fixing the piezoelectric layer to the membrane by anodic bonding, and/or fixing the membrane to a body by anodic bonding and incorporating the actuator in a printhead.

In another aspect, the invention features a nozzle plate including a monolithic semiconductor body including a buried layer, an upper face, and a lower face. The body defines a plurality of fluid paths, each including a nozzle path and a nozzle opening. The nozzle path includes an accelerator region. The nozzle opening is defined in the lower face of the body and the accelerator region is between the lower face and the buried layer.

In another aspect, the invention features a nozzle plate, including a monolithic semiconductor body including a plurality of fluid paths, each including a nozzle path, a nozzle opening, and a filter/impedance feature.

Other aspects or embodiments may include combinations of the features in the aspects above and/or one or more of the following.

The piezoelectric layer has a thickness of about 25 micron or less. The piezoelectric layer has a thickness of about 5 to 20 micron. The density of the piezoelectric layer is about 7.5 $g/cm^3$ or more. The piezoelectric layer has a $d_{31}$ coefficient of about 200 or more. The piezoelectric layer has a surface with an $R_a$ of about 0.05 micron or less. The piezoelectric layer is composed of pre-fired piezoelectric material. The piezoelectric layer is a substantially planar body of piezoelectric material. The filler material is a dielectric. The dielectric is selected from silicon oxide, silicon nitride, or aluminum oxide or paralyne. The filler material is ITO.

A semiconductor body defines a filter/impedance feature. The filter/impedance feature defines a plurality of flow openings in the fluid path. The filter/impedance feature has a plurality of projections in the flow path. At least one projection defines a partially enclosed region, e.g. defined by a concave surface. The projections are posts. At least one post includes an upstream-facing concave surface. The feature includes a plurality of rows of posts. A first upstream row and a last downstream row and posts in the first row have an upstream-facing convex surface and posts in the last row have downstream-facing convex surfaces. The posts between the first and second row include an upstream-facing concave surface. The posts have upstream-facing concave surfaces adjacent said posts having downstream-facing concave surfaces. The feature comprises a plurality of apertures through a wall member. The cross-sectional dimension of the openings is about 50% to about 70% of the cross-sectional dimension of the nozzle opening. The filter/impedance feature is upstream of the pumping chamber. The filter/impedance feature is downstream of the pumping chamber.

The cross-sectional dimension of the flow opening is less than the cross-sectional dimension of the nozzle opening. A filter/impedance feature has a concave surface region. The cross-section of the flow openings is about 60% or less than the cross-section of the nozzle opening. The sum of the area of the flow openings is about 2 or more times the cross section of the nozzle opening.

Flow is substantially developed in a time corresponding to the fire pulse width, e.g. flow development at the center of the opening reaches about 65% or more of the maximum. The t/(flow development time) is about 0.75 or greater. The fire pulse width is about 10 micro-sec, or less. The pressure drop across the feature is less than, e.g. 0.5 to 0.1, of the pressure drop across the nozzle flow path.

The actuator includes an actuator substrate bonded to the semiconductor body. The actuator substrate is attached to the semiconductor body by an anodic bond. The actuator substrate is selected from glass, silicon, alumina, zirconia, or quartz. The actuator substrate has a thickness of about 50 micron or less, e.g. 25 microns or less, e.g. 5 to 20 microns. The actuator substrate is bonded to the piezoelectric layer by an anodic bond. The actuator substrate is bonded to the piezoelectric layer through an amorphous silicon layer. The piezoelectric layer is bonded to the actuator substrate by organic adhesive. The actuator substrate extends along the fluid path beyond the piezoelectric layer. A portion of the actuator substrate extends along the fluid path beyond the pumping chamber has reduced thickness. The actuator substrate is transparent.

The semiconductor body includes at least two differentially etchable materials. The semiconductor body includes at least one buried layer, the nozzle flow path includes a varying cross-section and a buried layer is between regions of different cross-section regions. The pumping chamber is defined in the upper face of the body. The nozzle flow path includes a descender region for directing fluid from the pumping chamber toward the lower face and an accelerator region directing fluid from the descender region to the nozzle opening. The buried layer is at the junction of the descender region and the accelerator region. The cross-section of the accelerator region and/or the descender regions and/or accelerator region is substantially constant. The cross-section of the accelerator region decreases toward the nozzle opening. The cross-section has a curvilinear region. The ratio of the length of the accelerator region to the nozzle opening cross-section is about 0.5 or more, e.g. about 1.0 or more. The ratio is about 5.0 or less. The length of the accelerator region is about 10 to 50 micron. The nozzle opening has a cross-section of about 5 to 50 micron.

The pumping chambers are defined between substantially linear chamber sidewalls and the nozzle flow path is defined by a substantially collinear extension of one of the side walls. The body defines a plurality of pairs of flow paths, wherein the pairs of flow paths have adjacent nozzles and the pumping chamber sidewalls are substantially collinear. The nozzle flow paths in said pairs of nozzles are interdigitated. The nozzles in said plurality of pairs define a substantially straight line. The nozzle flow paths have a region with long cross-section and a short cross-section and the short cross-section is substantially parallel with the line of nozzle openings.

The thickness of the piezoelectric layer and/or the membrane is reduced by grinding. The piezoelectric layer is fired prior to attachment to the body. The piezoelectric layer is attached to an actuator substrate and the actuator substrate is attached to the body. The piezoelectric layer is attached to the actuator substrate by anodic bonding. The piezoelectric layer is attached to the actuator substrate by an organic adhesive. The actuator substrate is attached to the body prior to attaching the piezoelectric layer to the actuator substrate. The thickness of the actuator substrate is reduced after attaching the actuator substrate to the body. The actuator substrate is attached to the body by anodic bonding. The body is a semiconductor and the actuator substrate is glass or silicon. The piezoelectric actuator includes a piezoelectric layer and a membrane of glass or silicon and anodically bonding said membrane to the body. The piezoelectric layer is anodically bonded to the membrane. The piezoelectric actuator includes a metalized layer over the piezoelectric layer and a layer of silicon oxide or silicon over said metalized layer.

The method includes providing a body defining a flow path, and attaching the actuator to the body by an anodic bond. Flow path features such as ink supply paths, filter/impedance features, pumping chambers, nozzle flow paths, and/or nozzle openings are formed by etching semiconductor, as described below.

Aspects and features related to piezoelectric materials can be used with printheads including flow paths defined by non-monolithic and/or non-semiconductor bodies. Aspects and features related to use of monolithic bodies defining flow paths can be used with non-piezoelectric actuators, e.g. electrostatic or bubble-jet actuators. Aspects and features related to filter/impedance can be utilized with non-piezoelectric or piezoelectric actuators and monolithic or non-monolithic bodies.

Still further aspects, features, and advantages follow.

DESCRIPTION OF DRAWINGS

FIG. 1 is a perspective view of a printhead, while

FIG. 4A is a cross-sectional assembly view through a flow path in a printhead module, while

FIG. 6A is a plot of flow velocity across a flow opening, while

FIG. 12A is a cross-sectional view of a printhead module, while

FIG. 13A is a cross-sectional view of a printhead module, while

FIG. 14A is a cross-sectional view of a printhead module, while

FIG. 15A is a cross-sectional view of a printhead module, while

FIG. 16A is a cross-sectional view of a printhead module while

STRUCTURE

Figure 1:
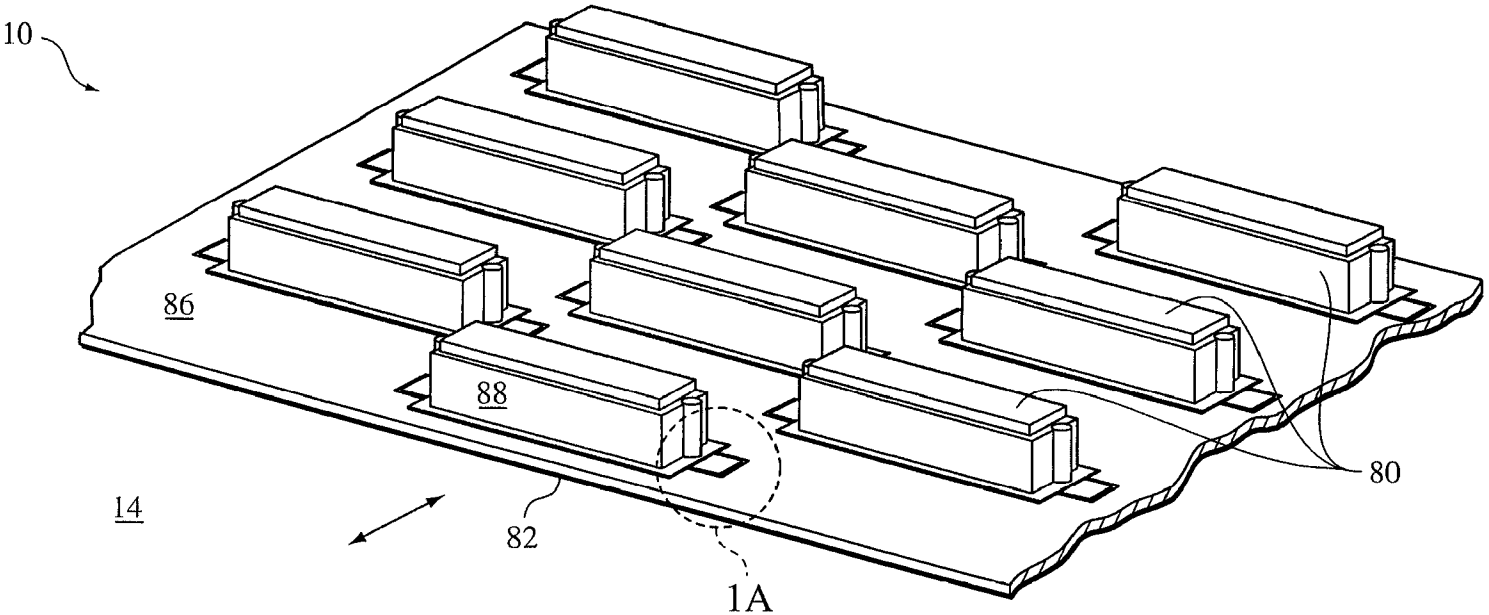
Figure 1A:
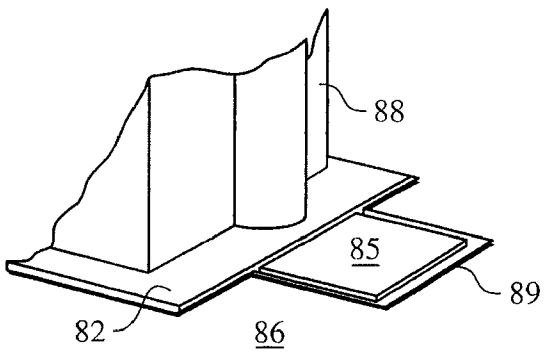
FIG. 1A is an enlarged view of the area A in FIG. 1, and FIGS. 1B and 1C are assembly views of a printhead unit.

Referring to FIG. 1, an ink jet printhead 10 includes printhead units 80 which are held in an enclosure 86 in a manner that they span a sheet 14, or a portion of the sheet, onto which an image is printed. The image can be printed by selectively jetting ink from the units 80 as the printhead 10 and the sheet 14 move relative to one another (arrow). In the embodiment in FIG. 1A, three sets of printhead units 80 are illustrated across a width of, e.g., about 12 inches or more. Each set includes multiple printhead units, in this case three, along the direction of relative motion between the printhead and the sheet. The units can be arranged to offset nozzle openings to increase resolution and/or printing speed. Alternatively, or in addition, each unit in each set can be supplied ink of a different type or color. This arrangement can be used for color printing over the full width of the sheet in a single pass of the sheet by the printhead.

Figure 1B:
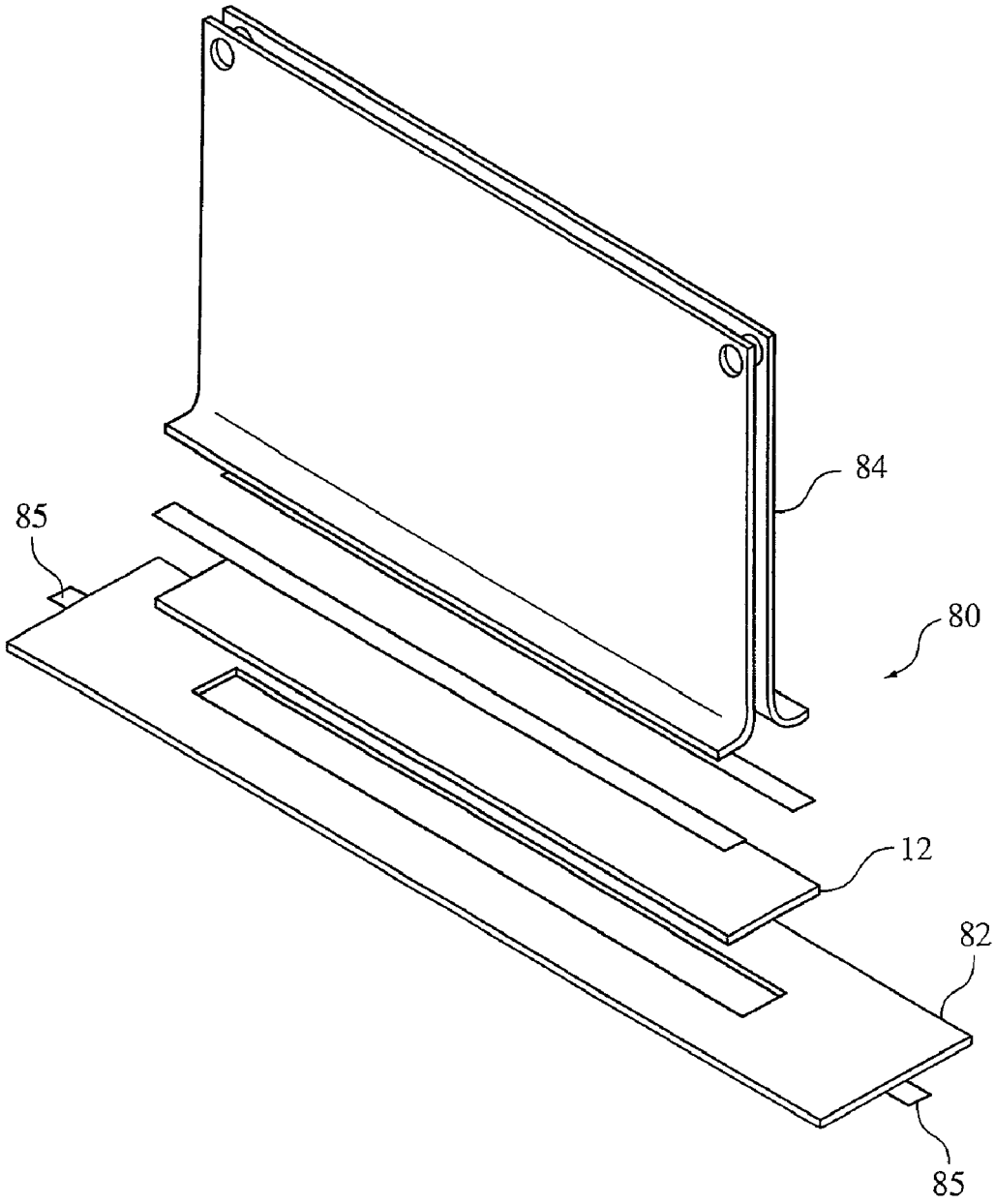
Figure 1C:
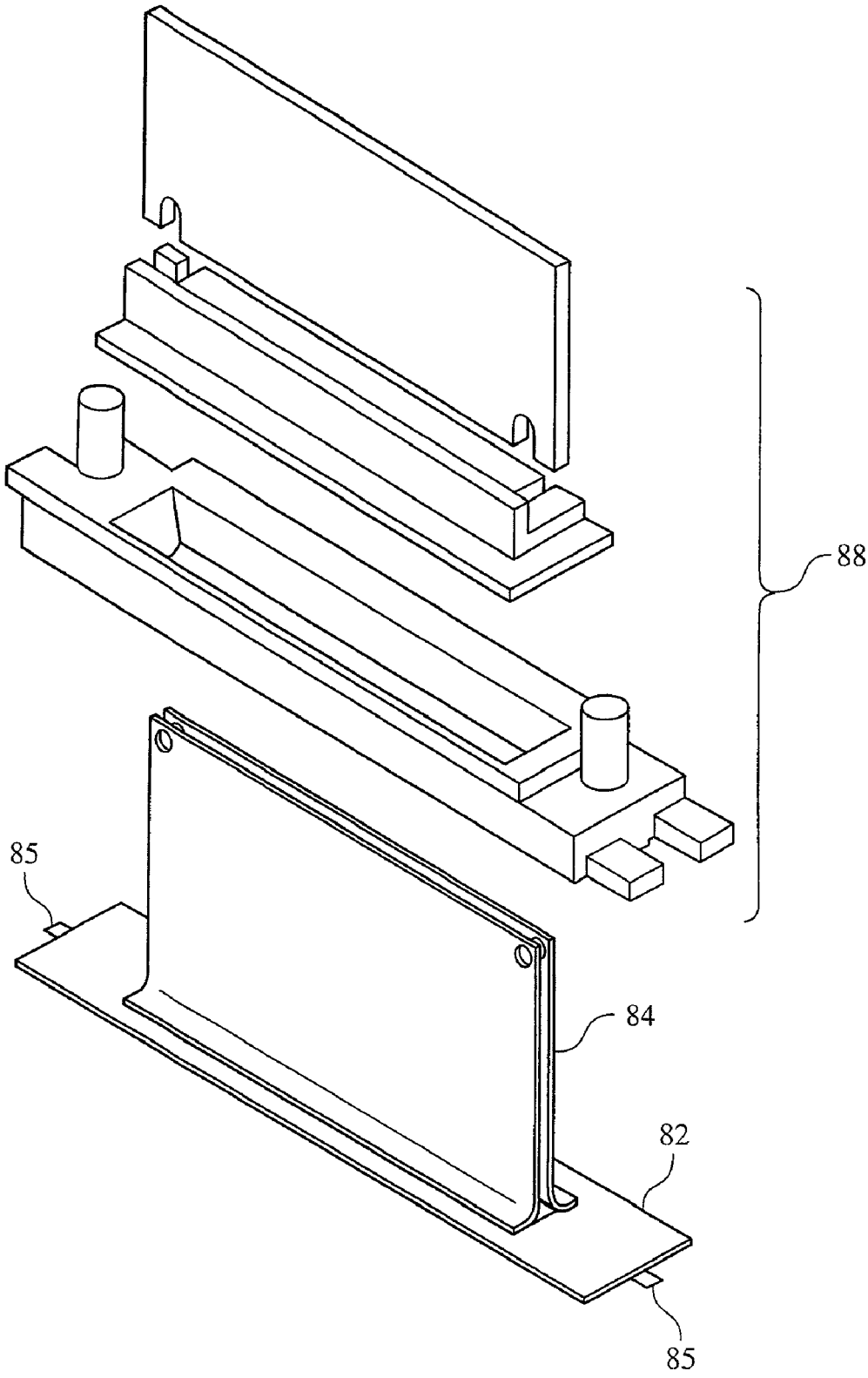

Referring as well to FIGS. 1B and 1C, each printhead unit 80 includes a printhead module 12 which is positioned on a faceplate 82 and to which is attached a flex print 84 for delivering drive signals that control ink ejection. Referring particularly to FIG. 1C, the faceplate 82 is attached to a manifold assembly 88 which includes ink supply paths for delivering ink to the module 12.

Figure 2A:
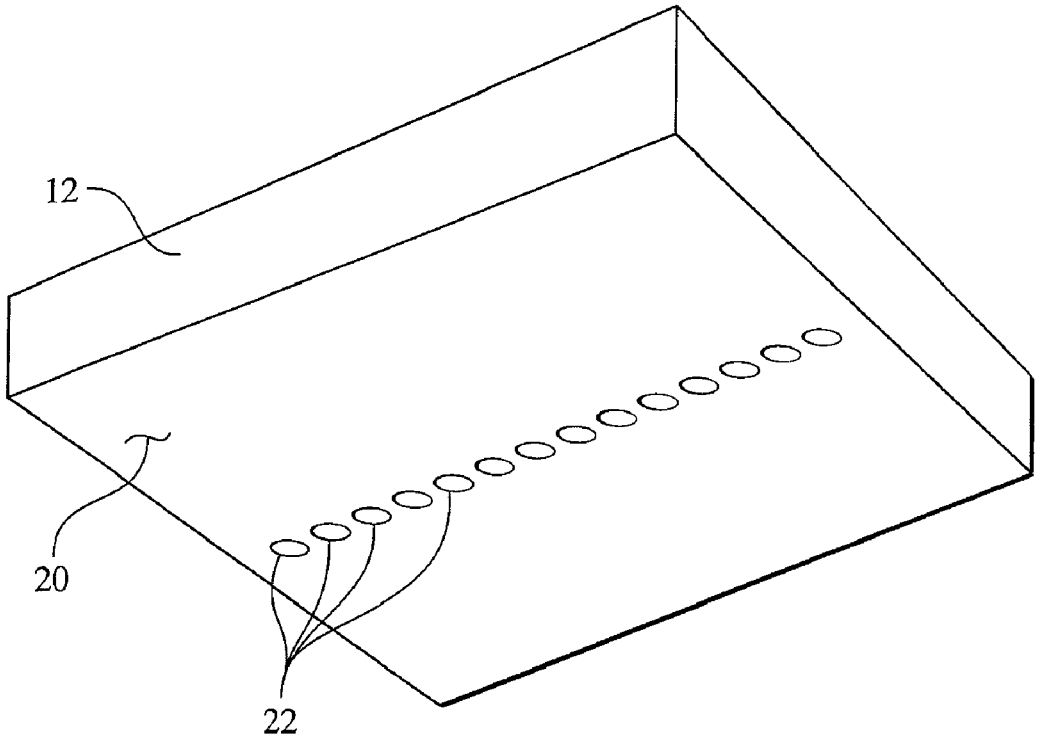
FIGS. 2A and 2B are perspective views of a printhead module.
Figure 2B:
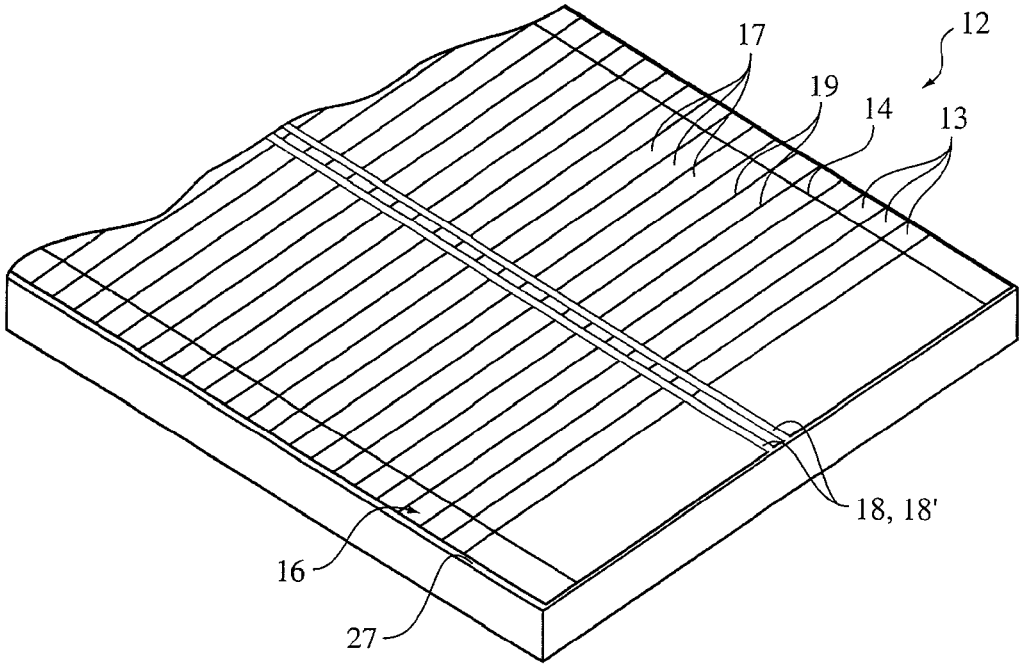

Referring as well to FIG. 2A, each module 12 has a front surface 20 that defines an array of nozzle openings 22 from which ink drops are ejected. Referring to FIG. 2B, each module 12 has on its back portion 16 a series of drive contacts 17 to which the flex print is attached. Each drive contact corresponds to an actuator and each actuator is associated with an ink flow path so that ejection of ink from each nozzle opening is separately controllable. In a particular embodiment, the module 12 has an overall width of about 1.0 cm and a length of about 5.5 cm. In the embodiment illustrated, the module has a single row of nozzle openings. However, modules can be provided with multiple rows of nozzle openings. For example, the openings in one row may be offset relative to another row to increase resolution. Alternatively or in addition, the ink flow paths corresponding to the nozzles in different rows may be provided with inks of different colors or types (e.g. hot melt, UV curable, aqueous-based). The dimensions of the module can be varied e.g., within a semiconductor wafer in which the flow paths are etched, as will be discussed below. For example, the width and length of the module may be 10 cm or more.

Figure 3:
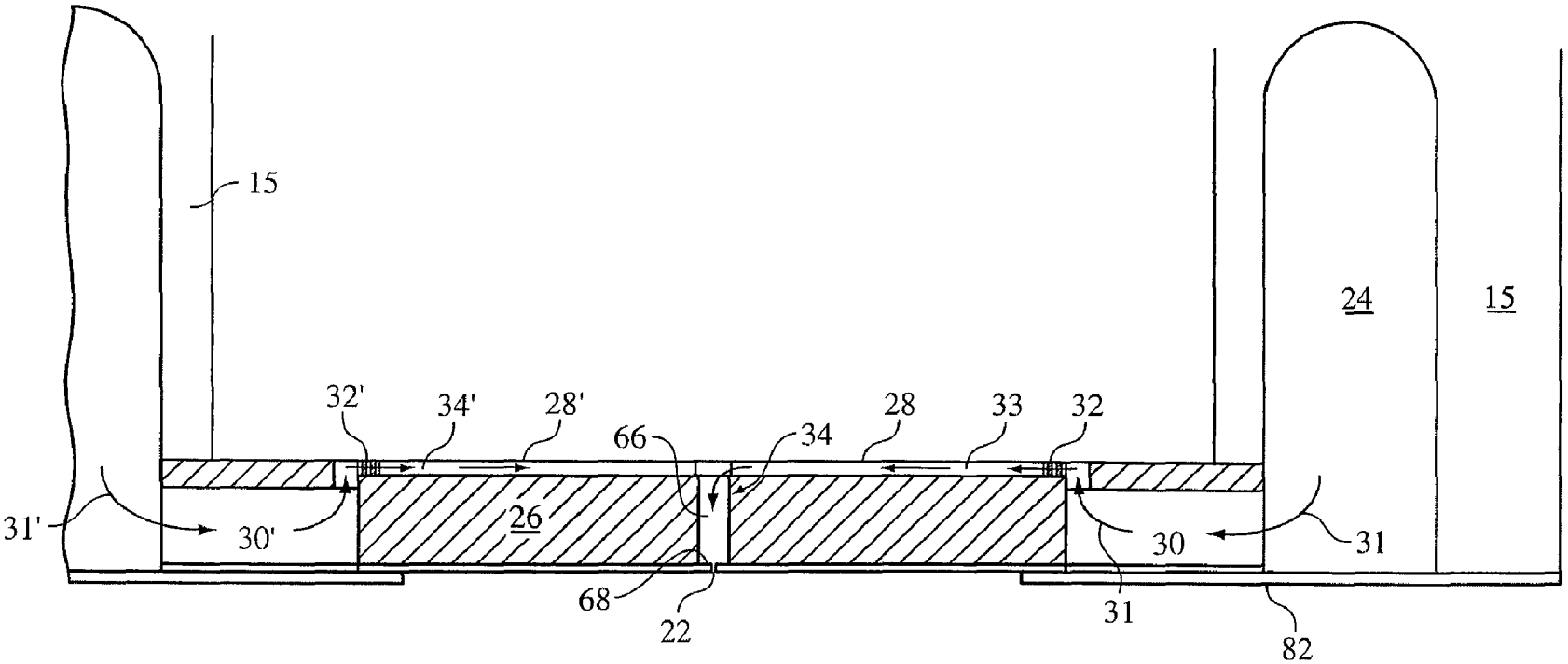
FIG. 3 is a cross-sectional view of a printhead unit.

Referring as well to FIG. 3, the module 12 includes a module substrate 26 and piezoelectric actuators 28, 28'. The module substrate 26 defines module ink supply paths 30, 30', filter/impedance features 32, 32', pumping chambers 33, 33', nozzle flow paths 34, 34', and nozzle openings 22. Actuators 28, 28' are positioned over the pumping chambers 33, 33'. Pumping chambers 33, 33' supplying adjacent nozzles are on alternate sides of the center line of the module substrate. The faceplate 82 on the manifold assembly covers the lower portion of the module supply paths 30, 30'. Ink is supplied (arrows 31) from a manifold flow path 24, enters the module supply path 30, and is directed to the filter/impedance feature 32. Ink flows through the filter/impedance feature 32 to the pumping chamber 33 where it is pressurized by the actuator 28 such that it is directed to the nozzle flow path 34 and out of the nozzle opening 22.

Module Substrate

Figure 4A:
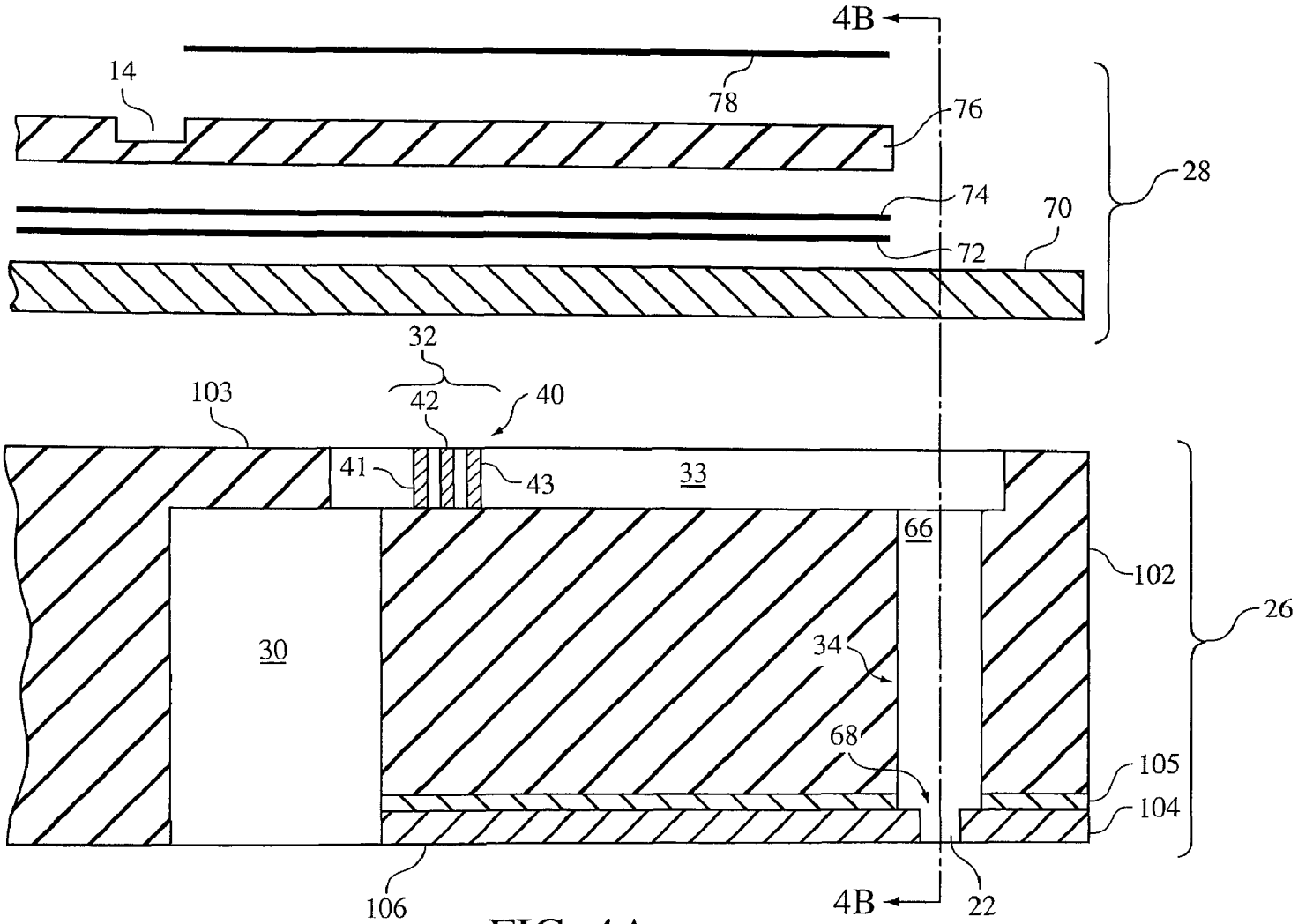
Figure 4B:
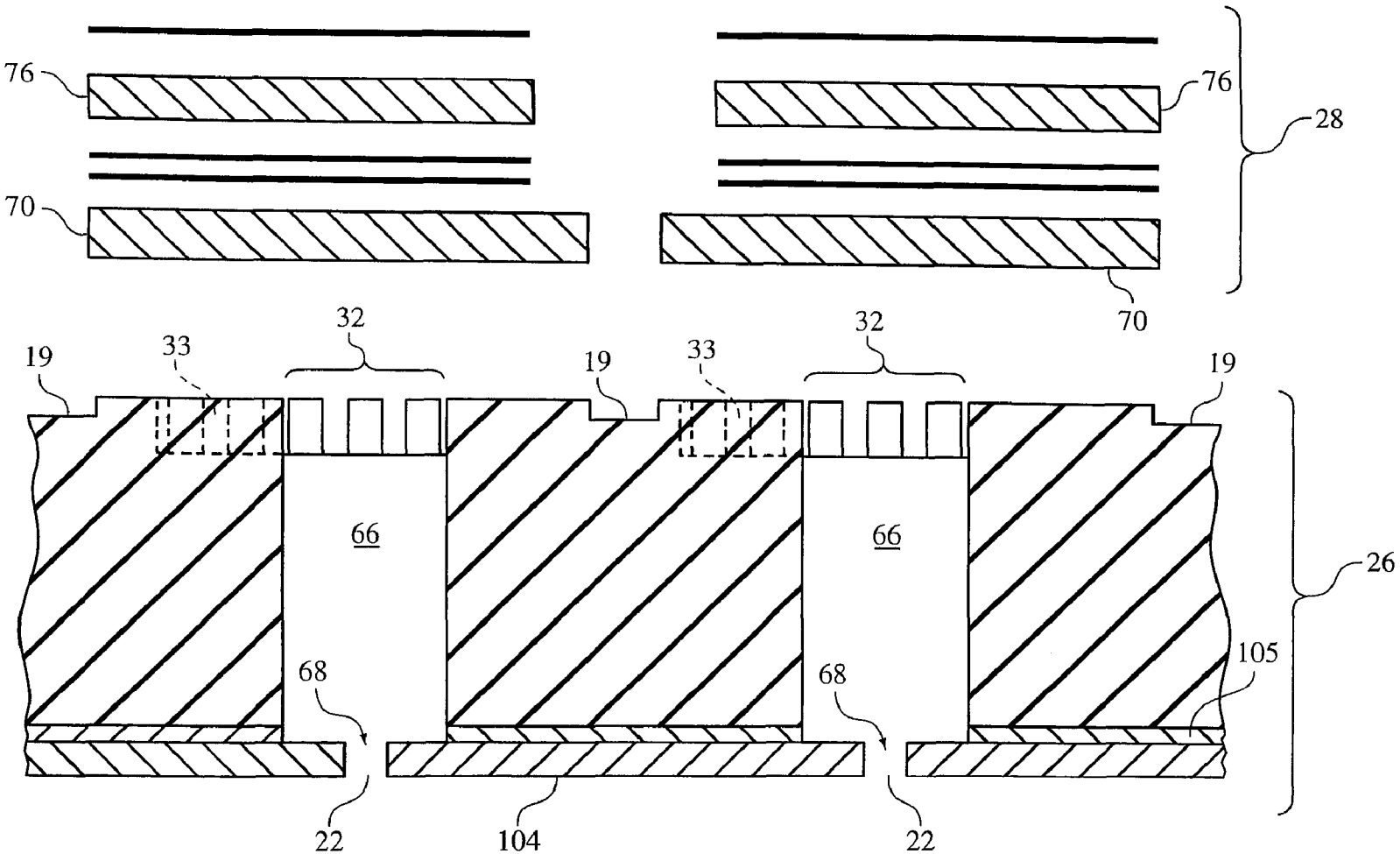
FIG. 4B is a cross-sectional assembly view of a module along line BB in FIG. 4A.

Referring particularly to FIGS. 4A and 4B, the module substrate 26 is a monolithic semiconductor body such as a silicon on insulator (SOI) substrate in which ink flow path features are formed by etching. The SOI substrate includes an upper layer of single crystal silicon known as the handle 102, a lower layer of single crystal silicon known as the active layer 104, and a middle or buried layer of silicon dioxide known as the BOX layer 105. The pumping chambers 33 and the nozzle openings 22 are formed in opposite parallel surfaces of the substrate. As illustrated, pumping chamber 33 is formed in a back surface 103 and nozzle opening 22 is formed in a front surface 106. The thickness uniformity of the monolithic body, and among monolithic bodies of multiple modules in a printhead, is high. For example, thickness uniformity of the monolithic members, can be, for example, about ±1 micron or less for a monolithic member formed across a 6 inch polished SOI wafer. As a result, dimensional uniformity of the flow path features etched into the wafer is not substantially degraded by thickness variations in the body. Moreover, the nozzle openings are defined in the module body without a separate nozzle plate. In a particular embodiment, the thickness of the active layer 104 is about 1 to 200 micron, e.g., about 30 to 50 micron, the thickness of the handle 102 is about 200 to 800 micron, and the thickness of the BOX layer 105 is about 0.1 to 5 micron, e.g., about 1 to 2 micron. The pumping chambers have a length of about 1 to 5 mm, e.g., about 1 to 2 mm, a width of about 0.1 to 1 mm, e.g., about 0.1 to 0.5 mm and a depth of about 60 to 100 micron. In a particular embodiment, the pumping chamber has a length of about 1.8 mm, a width of about 0.21 mm, and a depth of about 65 micron. In other embodiments, the module substrate may be an etchable material such as a semiconductor wafer without a BOX layer.

Figure 5A:
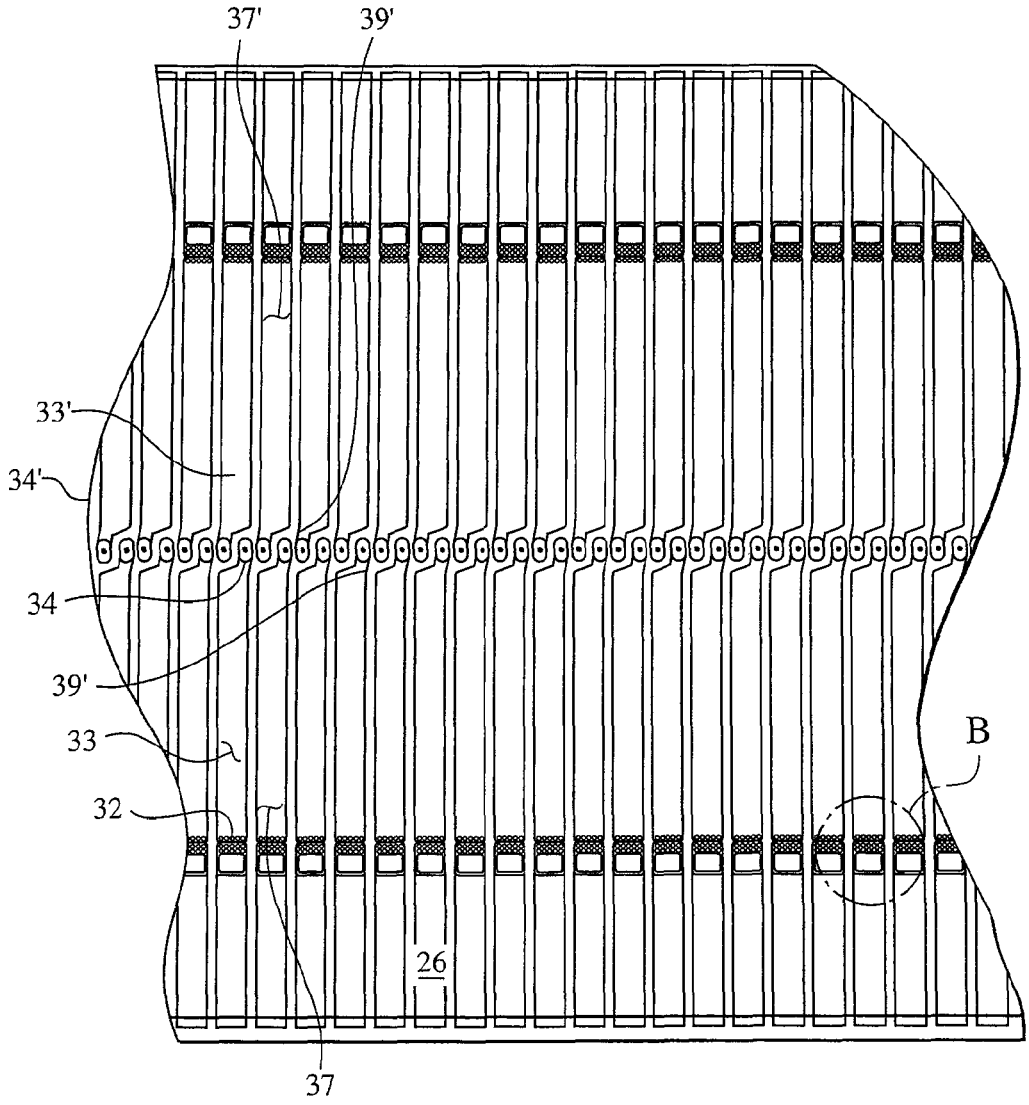
FIG. 5A is a top view of a portion printhead module body and FIG. 5B is an enlarged view of region B in FIG. 5A.
Figure 5B:
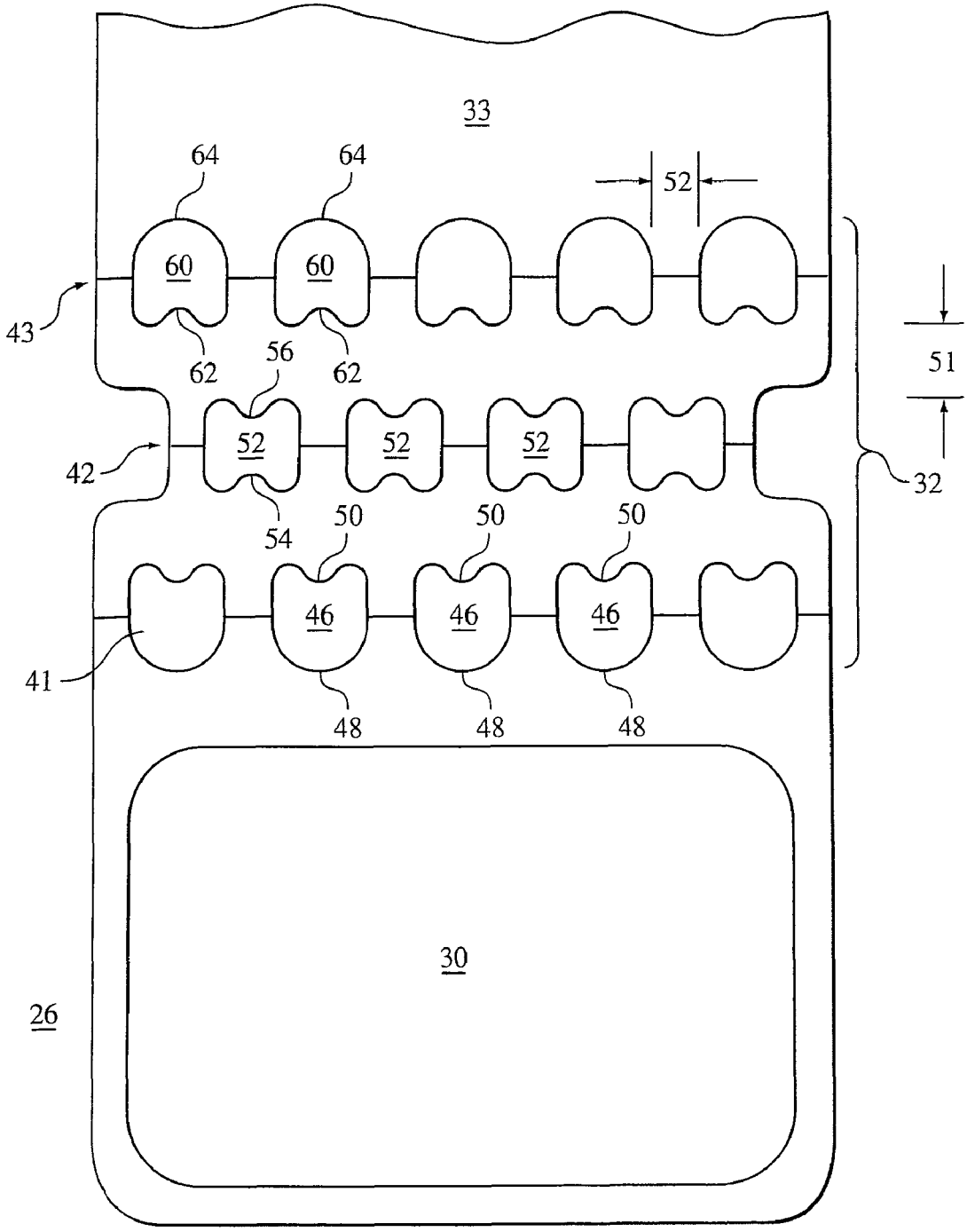

Referring as well to FIGS. 5A and 5B, the module substrate 26 defines a filter/impedance feature 32 located upstream of the pumping chamber 33. Referring particularly to FIG. 5B, the filter/impedance feature 32 is defined by a series of projections 40 in the flow path which are arranged, in this example, in three rows 41, 42, 43 along the direction of ink flow. The projections, which in this example are parallel posts, are integral with the module substrate. The filter/impedance feature can be constructed to provide filtering only, acoustic impedance control only, or both filtering and acoustic impedance control. The location, size, spacing, and shape of the projections are selected to provide filtering and/or a desired acoustic impedance. As a filter, the feature traps debris such as particulates or fibers so that they do not reach and obstruct the nozzle flow path. As an acoustic impedance element, the feature absorbs pressure waves propagating from the pumping chamber 33 toward the ink supply flow path 30, thus reducing acoustic crosstalk among chambers in the module and increasing operating frequency.

Referring particularly to FIG. 5B, the posts are arranged along the ink flow path such that each row of posts is offset from the adjacent row of posts to effectively avoid a direct flow path through the feature, which improves filtering. In addition, the shape of the posts improves filtering performance. In this example, posts 46 in the first row 41 include an upstream surface 48 that is generally convex and a downstream surface 50 that is generally concave, forming a partially enclosed well area 47. The posts 52 in row 42 include upstream 54 and downstream 56 concave surfaces. The posts 60 in the last row 43 include downstream convex surfaces 62 and upstream concave surfaces 64. As ink flows into the feature 32 from the module ink flow path 30, the convex surface 48 of the posts 46 in the first row 41 provide a relatively low turbulence-inducing flow path into the feature. The concave surfaces on the posts in the first, second, and third rows enhance filtering function, particularly for filtering long, narrow contaminants such as fibers. As a fiber travels with the ink flow beyond the first row 41, it tends to engage and be retarded by the downstream concave surfaces 54, 62 of the second or third row of posts and become trapped between the upstream concave surfaces 54, 62 and the downstream concave surfaces 50, 56. The downstream convex surface 64 on the third row 43 encourages low turbulence flow of filtered ink into the chamber. In embodiments, the concave surface can be replaced by other partially enclosing shapes that define, for example, rectangular or triangular well areas.

The spaces between the posts define flow openings. The size and number of the flow openings can provide desirable impedance and filtering performance. The impedance of a flow opening is dependent on the flow development time of a fluid through the opening. The flow development time relates to the time it takes a fluid at rest to flow at a steady velocity profile after imposition of pressure. For a round duct, the flow development time is proportional to:

$$(\text{fluid density})*r^2/(\text{fluid viscosity})$$

where r is the radius of the opening. (For rectangular openings, or other opening geometries, r is one-half the smallest cross-sectional dimension.) For a flow development time that is relatively long compared to the duration of incident pulses, the flow opening acts as an inductor. But for a flow development time that is relatively short compared to the duration of incident pressure pulses, the flow opening acts as a resistor, thus effectively dampening the incident pulses.

Figure 6A:
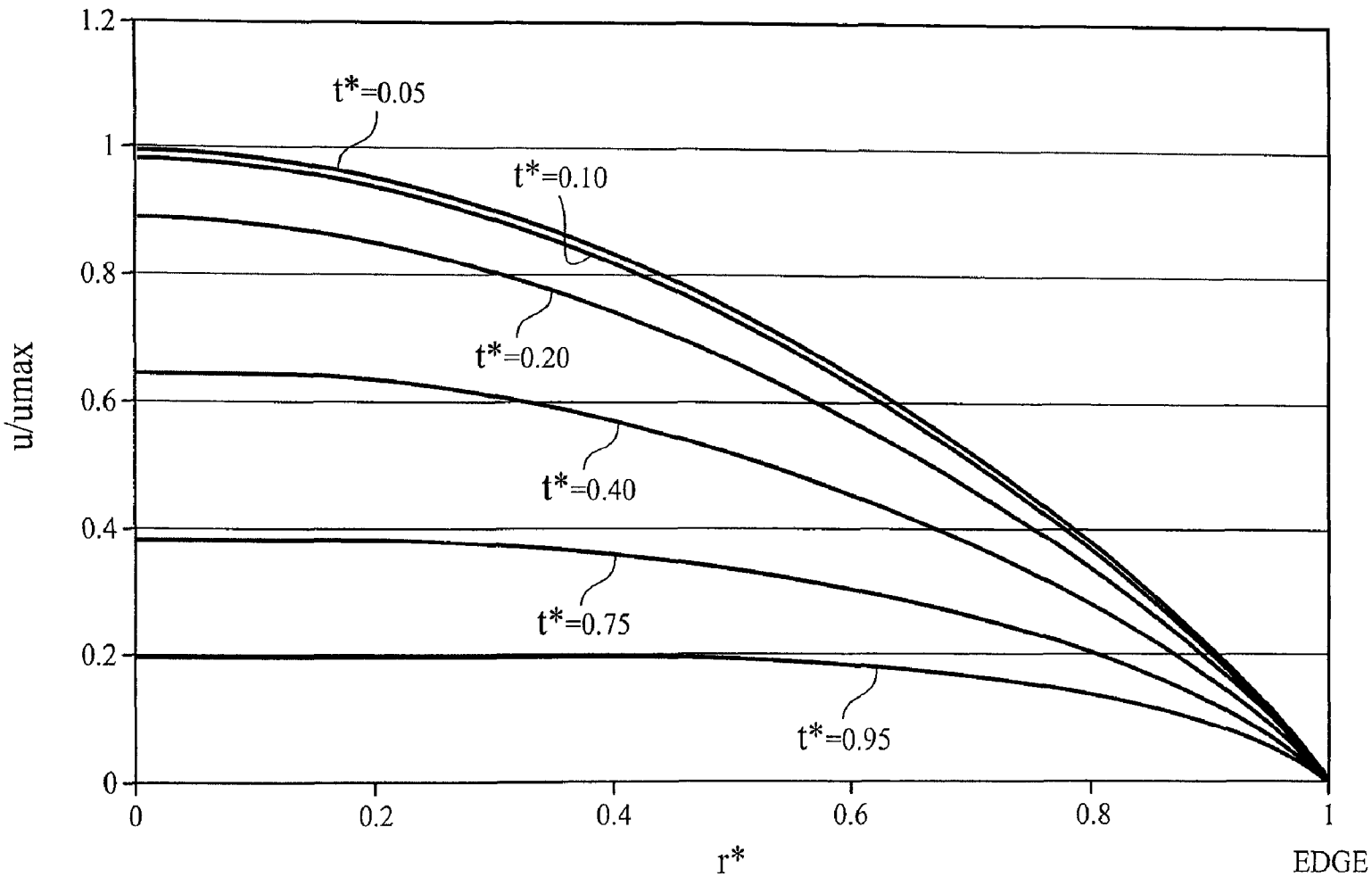

Preferably, the flow is substantially developed in times corresponding to the fire pulse width. Referring to FIG. 6A, flow development across a tube is illustrated. The graph plots velocity U over the maximum velocity $U_{max}$, across an opening, where r*=0 is the center of the opening and r*=1 is the periphery of the opening. The flow development is plotted for multiple t*, where t* is the pulse width, t, divided by the flow development time. This graph is further described in F. M. White, Viscous Fluid Flow, McGraw-Hill, 1974, the entire contents of which is incorporated by reference. The graph in FIG. 6A is discussed on p. 141-143.

As FIG. 6A illustrates, at about t*=0.2 or greater, flow development at the center of the opening reaches about 65% of maximum. At about t*=0.75, flow development is about 95% of maximum. For a given t* and pulse width, flow opening size can be selected for a fluid of given density and viscosity. For example, for t*=0.75, an ink having a density of about 1000 kg/m$^3$ and a viscosity of about 0.01 Pascal-sec., and where the pulse width is 7.5 microsec, then r=10 e-6 m and the diameter of the openings should be about 20 micron or less.

Figure 6B:
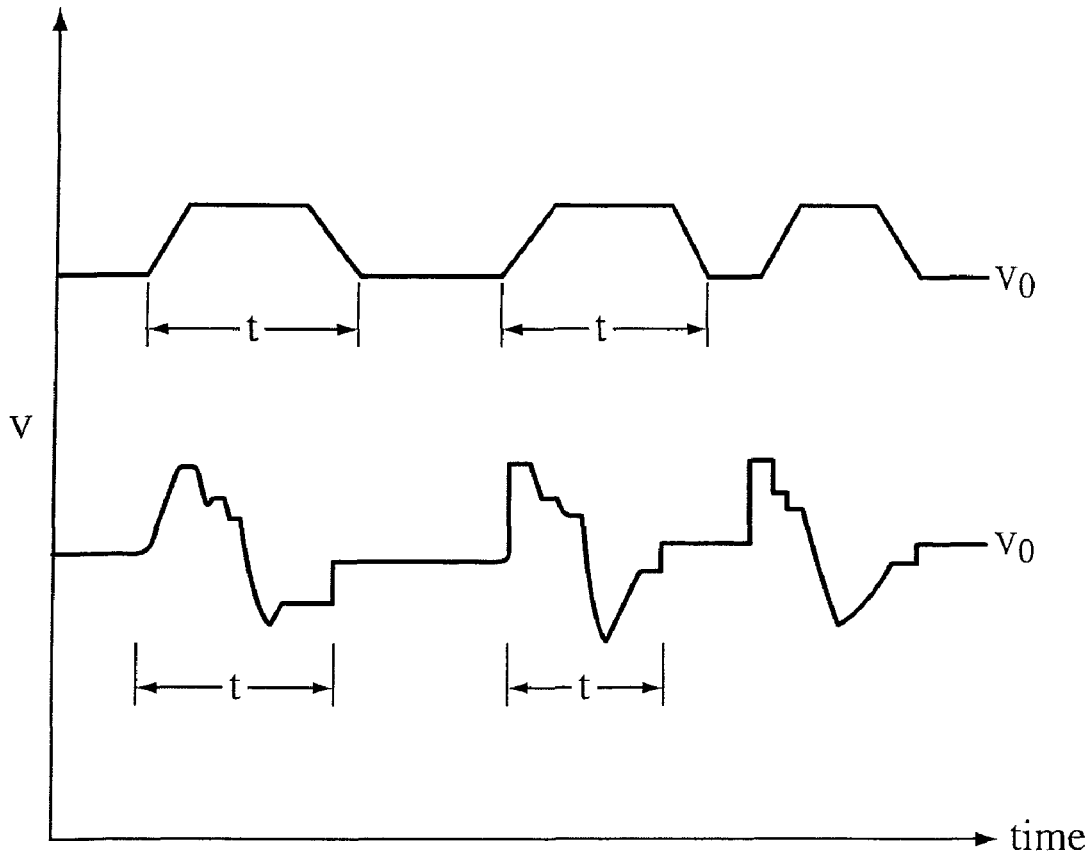
FIG. 6B is a plot of voltage as a function of time illustrating drive signals.

Referring to FIG. 6B, pulse width, t, is the duration of voltage application used for drop ejection. Two drive signal trains are illustrated, each having three drop-ejection waveforms. The voltage on an actuator is typically maintained at a neutral state until drop ejection is desired, at which time the ejection waveform is applied. For example, for a trapezoidal waveform, the pulse width, t, is the width of the trapezoid. For more complex waveforms, the pulse width is the time of a drop ejection cycle, e.g., the time from initiation of the ejection waveform to the return to the starting voltage.

The number of flow openings in the feature can be selected so that a sufficient flow of ink is available to the pumping chamber for continuous high frequency operation. For example, a single flow opening of small dimension sufficient to provide dampening could limit ink supply. To avoid this ink starvation, a number of openings can be provided. The number of openings can be selected so that the overall flow resistance of the feature is less than the flow resistance of the nozzle. In addition, to provide filtering, the diameter or smallest cross sectional dimension of the flow openings is preferably less than the diameter (the smallest cross-section) of the corresponding nozzle opening, for example 60% or less of the nozzle opening. In a preferred impedance/filtering feature, the cross section of the openings is about 60% or less than the nozzle opening cross section and the cross sectional area for all of the flow openings in the feature is greater than the cross sectional area of the nozzle openings, for example about 2 or 3 times the nozzle cross sectional area or more, e.g. about 10 times or more. For a filter/impedance feature in which flow openings have varying diameters, the cross sectional area of a flow opening is measured at the location of its smallest cross sectional dimension. In the case of a filter/impedance feature that has interconnecting flow paths along the direction of ink flow, the cross-sectional dimension and area are measured at the region of smallest cross-section. In embodiments, pressure drop can be used to determine flow resistance through the feature. The pressure drop can be measured at jetting flow. Jetting flow is the drop volume/fire pulse width. In embodiments, at jetting flow, the pressure drop across the impedance/filter feature is less than the pressure drop across the nozzle flow path. For example, the pressure drop across the feature is about 0.5 to 0.1 of the pressure drop across the nozzle flow path.

The overall impedance of the feature can be selected to substantially reduce acoustic reflection into the ink supply path. For example, the impedance of the feature may substantially match the impedance of the pumping chamber. Alternatively, it may be desirable to provide impedance greater than the chamber to enhance the filtering function or to provide impedance less than the chamber to enhance ink flow. In the latter case, crosstalk may be reduced by utilizing a compliant membrane or additional impedance control features elsewhere in the flow path as will be described below. The impedance of the pumping chamber and the filter/impedance feature can be modeled using fluid dynamic software, such as Flow 3D, available from Flow Science Inc., Santa Fe, N.M.

In a particular embodiment, the posts have a spacing along the flow path, $S_1$, and a spacing across the flow path, $S_2$, of about 15 micron and the nozzle opening is about 23 micron (FIG. 5B). The width of the posts is about 25 micron. In the embodiment in FIG. 5, the three rows of posts in the filter/impedance feature act as three in-series acoustic resistors. The first and last rows provide six flow openings and the middle row provides five flow openings. Each of the flow openings has a minimum cross-section of about 15 micron, which is smaller than the cross-section of the nozzle opening (23 micron). The sum of the area of the openings in each row is greater than the area of the nozzle opening. A feature defined by projections for impedance control and/or filtering has the advantage that the spacing, shape arrangement and size of the projections both along and across the flow path can, for example, provide a tortuous fluid pathway effective for filtering, with flow passages sized for effective dampening. In other embodiments, as discussed below, the filter/impedance feature may be provided by a partition(s) having a series of apertures.

Referring particularly to FIG. 5A, the module substrate also defines pumping chambers 33 33' which feed respective nozzle flow paths 34, 34'. The pumping chambers 33, 33' are positioned opposite one another across the nozzle opening line and have sidewalls 37, 37' that are generally collinear. To obtain a straight line of closely spaced nozzle openings, the nozzle flow paths join the pumping chamber along extensions 39, 39' of one of the sidewalls, forming an indigitated pattern of nozzle flow paths. In addition, to maintain a relatively low volume at the transition between the pumping chamber and the nozzle flow path, the shape in the transition is ovaloid, with the smaller axis along the nozzle opening line. As described below, this orientation provides a small nozzle opening pitch and a relatively large nozzle path volume. In addition, manufacturing is simplified since straight line saw cuts can be made across the module to separate adjacent chambers and form isolation cuts on both sides of the nozzle line.

Referring back to FIGS. 4A and 4B, the module substrate also defines nozzle flow path 34. In this example, the nozzle flow path 34 directs ink flow orthogonally with respect to the upper and lower module substrate surfaces. The nozzle flow path 34 has an upper descender region 66 and a lower accelerator region 68. The descender region 66 has a relatively large volume and the accelerator region 68 has a relatively small volume. The descender region 66 directs ink from the pumping chamber 33 to the accelerator region 68, where the ink is accelerated before it is ejected from the nozzle opening 22. The uniformity of the accelerator regions 68 across the module enhances the uniformity of the ink drop size and the ink drop velocity. The accelerator region length is defined between the front face 106 and the BOX layer 105 of the module body. In addition, BOX layer 105 is at the interface of the descender 66 and accelerator 68 regions. As will be discussed below, the BOX layer 105 acts as an etch stop layer during manufacture to accurately control etch depth and nozzle uniformity.

The accelerator region illustrated in FIG. 4A is a generally cylindrical path of constant diameter corresponding to the orifice opening diameter. This region of small, substantially constant diameter upstream of the nozzle opening enhances printing accuracy by promoting drop trajectory straightness with respect to the axis of the nozzle opening. In addition, the accelerator region improves drop stability at high frequency operation by discouraging the ingestion of air through the nozzle opening. This is a particular advantage in printheads that operate in a fill-before-fire mode, in which the actuator generates a negative pressure to draw ink into the pumping chamber before firing. The negative pressure can also cause the ink meniscus in the nozzle to be drawn inward from the nozzle opening. By providing an accelerator region with a length greater than the maximum meniscus withdrawal, the ingestion of air is discouraged. The accelerator region can also include a variable diameter. For example, the accelerator region may have funnel or conical shape extending from a larger diameter near the descender to a smaller diameter near the nozzle opening. The cone angle may be, for example, 5 to 30°. The accelerator region can also include a curvilinear quadratic, or bell-mouth shape, from larger to smaller diameter. The accelerator region can also include multiple cylindrical regions of progressively smaller diameter toward the nozzle opening. The progressive decrease in diameter toward the nozzle opening reduces the pressure drop across the accelerator region, which reduces drive voltage, and increases drop size range and fire rate capability. The lengths of the portions of the nozzle flow path having different diameters can be accurately defined using BOX layers which act as etch stop layers, as will be described below.

In particular embodiments, the ratio of the length of the accelerator region to the diameter of the nozzle opening is typically about 0.5 or greater, e.g., about 1 to 4, preferably about 1 to 2. The descender has a maximum cross-section of about 50 to 300 micron and a length of about 400-800 micron. The nozzle opening and the accelerator region have a diameter of about 5 to 80 micron, e.g. about 10 to 50 micron. The accelerator region has a length of about 1 to 200 micron, e.g., about 20 to 50 micron. The uniformity of the accelerator region length may be, for example, about ±3% or less or ±2 micron or less, among the nozzles of the module body. For a flow path arranged for a 10 pl drop, the descender has a length of about 550 micron. The descender has a racetrack, ovaloid shape with a minor width of about 85 micron and a major width of about 160 micron. The accelerator region has a length of about 30 micron and a diameter of about 23 microns.

Actuator

Referring to FIGS. 4A and 4B, the piezoelectric actuator 28 includes an actuator membrane 70, a bonding layer 72, a ground electrode layer 74, a piezoelectric layer 76, and a drive electrode layer 78. The piezoelectric layer 74 is a thin film of piezoelectric material having a thickness of about 50 micron or less, e.g. about 25 micron to 1 micron, e.g. about 8 to about 18 micron. The piezoelectric layer can be composed of a piezoelectric material that has desirable properties such as high density, low voids, and high piezoelectric constants. These properties can be established in a piezoelectric material by using techniques that involve firing the material prior to bonding it to a substrate. For example, piezoelectric material that is molded and fired by itself (as opposed to on a support) has the advantage that high pressure can be used to pack the material into a mold (heated or not). In addition, fewer additives, such as flow agents and binders, are typically required. Higher temperatures, 1200-1300° C. for example, can be used in the firing process, allowing better maturing and grain growth. Firing atmospheres (e.g. lead enriched atmospheres) can be used that reduce the loss of PbO (due to the high temperatures) from the ceramic. The outside surface of the molded part that may have PbO loss or other degradation can be cut off and discarded. The material can also be processed by hot isostatic pressing (HIPs), during which the ceramic is subject to high pressures, typically 1000-2000 atm. The Hipping process is typically conducted after a block of piezoelectric material has been fired, and is used to increase density, reduce voids, and increase piezoelectric constants.

Thin layers of prefired piezoelectric material can be formed by reducing the thickness of a relatively thick wafer. A precision grinding technique such as horizontal grinding can produce a highly uniform thin layer having a smooth, low void surface morphology. In horizontal grinding, a workpiece is mounted on a rotating chuck and the exposed surface of the workpiece is contacted with a horizontal grinding wheel. The grinding can produce flatness and parallelism of, e.g., 0.25 microns or less, e.g. about 0.1 micron or less and surface finish to 5 nm Ra or less over a wafer. The grinding also produces a symmetrical surface finish and uniform residual stress. Where desired, slight concave or convex surfaces can be formed. As discussed below, the piezoelectric wafer can be bonded to a substrate, such as the module substrate, prior to grinding so that the thin layer is supported and the likelihood of fracture and warping is reduced.

Figure 7A:
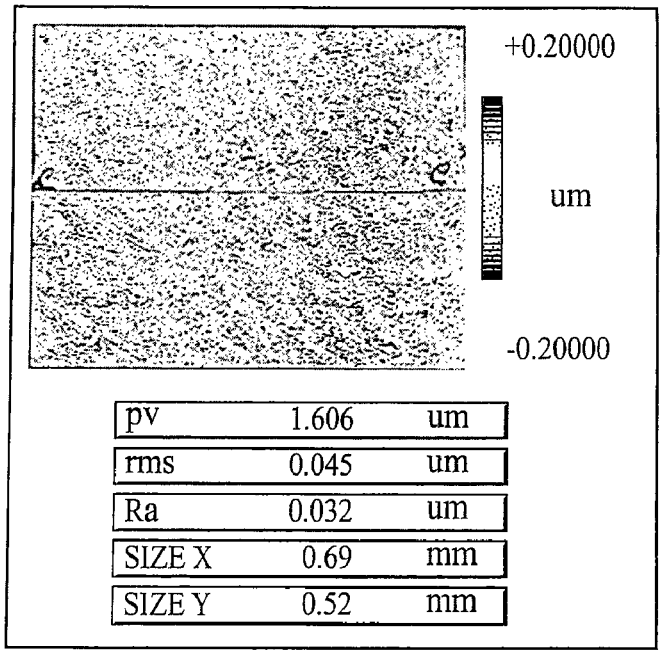
FIG. 7A is a plot of the surface profile of a piezoelectric layer.
Figure 7B:
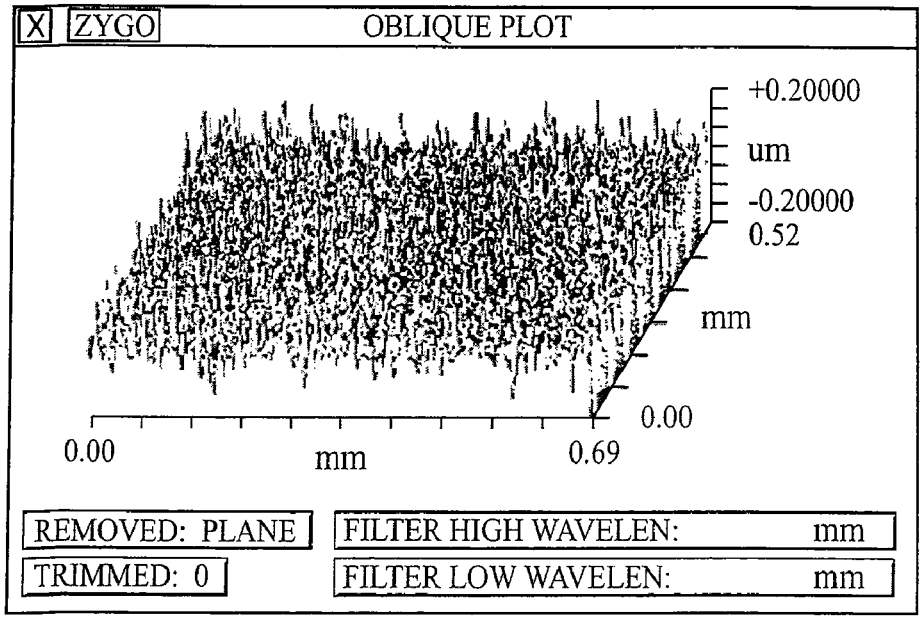
FIG. 7B is an oblique view of the surface profile.
Figure 7C:
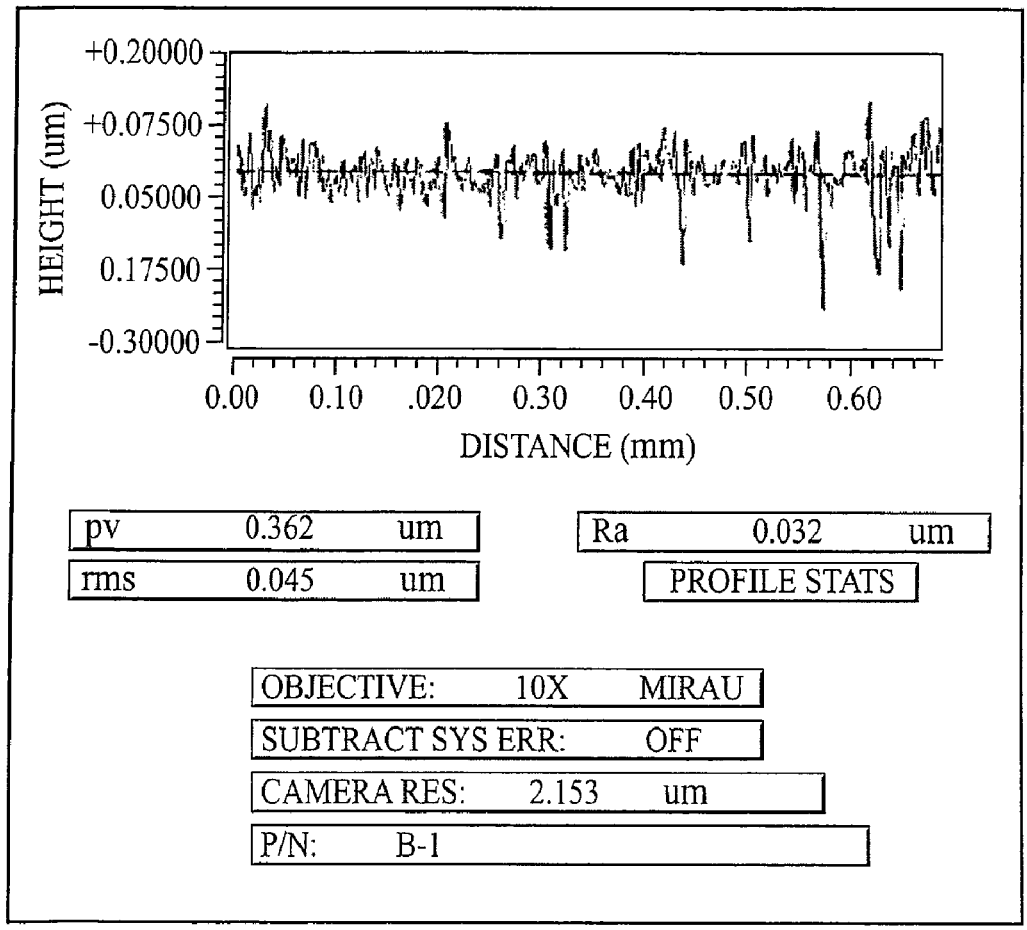
FIG. 7C illustrates the surface profile through line CC in FIG. 7A.

Referring particularly to FIG. 7A to 7C, interferometric profilometer data of a ground surface of piezoelectric material is provided. Referring particularly to FIG. 7A, the surface finish exhibits a series of substantially parallel ridges over an area of about 35 $mm^2$. The average peak to valley variation is about 2 micron or less, the rms is about 0.07 micron or less, and the Ra is about 0.5 micron or less. Referring particularly to FIG. 7B, the surface profile is illustrated in perspective. Referring particularly to FIG. 7C, the surface profile across a line CC in FIG. 7A is provided.

A suitable precision grinding apparatus is Toshiba Model UHG-130C, available through Cieba Technologies, Chandler, Ariz. The substrate can be ground with a rough wheel followed by a fine wheel. A suitable rough and fine wheel have 1500 grit and 2000 grit synthetic diamond resinoid matrix, respectively. Suitable grinding wheels are available from Adoma or Ashai Diamond Industrial Corp. of Japan. The workpiece spindle is operated at 500 rpm and the grinding wheel spindle is operated at 1500 rpm. The x-axis feed rate is 10 micron/min for first 200-250 micron using the rough wheel and 1 micron/min for last 50-100 micron using the fine wheel. The coolant is 18 mΩ deionized water. The surface morphology can be measured with a Zygo model Newview 5000 interferometer with Metroview software, available from Zygo Corp, Middlefield, Conn. The density of the piezoelectric material is preferably about 7.5 $g/cm^3$ or more, e.g., about 8 $g/cm^3$ to 10 $g/cm^3$. The $d_{31}$ coefficient is preferably about 200 or greater. HIPS-treated piezoelectric material is available as H5C and H5D from Sumitomo Piezoelectric Materials, Japan. The H5C material exhibits an apparent density of about 8.05 $g/cm^3$ and $d_{31}$ of about 210. The H5D material exhibits an apparent density of about 8.15 $g/cm^3$ and a $d_{31}$ of about 300. Wafers are typically about 1 cm thick and can be diced to about 0.2 mm. The diced wafers can be bonded to the module substrate and then ground to the desired thickness. The piezoelectric material can be formed by techniques including pressing, doctor blading, green sheet, sol gel or deposition techniques. Piezoelectric material manufacture is discussed in Piezoelectric Ceramics, B. Jaffe, Academic Press Limited, 1971, the entire contents of which are incorporated herein by reference. Forming methods, including hot pressing, are described at pages 258-9. High density, high piezoelectric constant materials are preferred but the grinding techniques can be used with lower performance material to provide thin layers and smooth, uniform surface morphology. Single crystal piezoelectric material such as lead-magnesium-niobate (PMN), available from TRS Ceramics, Philadelphia, Pa., can also be used.

Referring back to FIGS. 4A and 4B, the actuator also includes a lower electrode layer 74 and an upper electrode layer 78. These layers may be metal, such as copper, gold, tungsten, indium-tin-oxide (ITO), titanium or platinum, or a combination of metals. The metals may be vacuum-deposited onto the piezoelectric layer. The thickness of the electrode layers may be, for example, about 2 micron or less, e.g. about 0.5 micron. In particular embodiments, ITO can be used to reduce shorting. The ITO material can fill small voids and passageways in the piezoelectric material and has sufficient resistance to reduce shorting. This material is advantageous for thin piezoelectric layers driven at relatively high voltages. In addition, prior to application of the electrode layers, the piezoelectric material surfaces may be treated with a dielectric to fill surface voids. The voids may be filled by depositing a dielectric layer onto the piezoelectric layer surface and then grinding the dielectric layer to expose the piezoelectric material such that any voids in the surface remain filled with dielectric. The dielectric reduces the likelihood of breakdown and enhances operational uniformity. The dielectric material may be, for example, silicon dioxide, silicon nitride, aluminum oxide or a polymer. The dielectric material may be deposited by sputtering or a vacuum deposition technique such as PECVD.

The metalized piezoelectric layer is fixed to the actuator membrane 70. The actuator membrane 70 isolates the lower electrode layer 74 and the piezoelectric layer 76 from ink in the chamber 33. The actuator membrane 70 is typically an inert material and has compliance so that actuation of the piezoelectric layer causes flexure of the actuator membrane layer sufficient to pressurize ink in the pumping chamber. The thickness uniformity of the actuator membrane provides accurate and uniform actuation across the module. The actuator membrane material can be provided in thick plates (e.g. about 1 mm in thickness or more) which are ground to a desired thickness using horizontal grinding. For example, the actuator membrane may be ground to a thickness of about 25 micron or less, e.g. about 20 micron. In embodiments, the actuator membrane 70 has a modulus of about 60 gigapascal or more. Example materials include glass or silicon. A particular example is a boro-silicate glass, available as Boroflot EV 520 from Schott Glass, Germany. Alternatively, the actuator membrane may be provided by depositing a layer, e.g. 2 to 6 micron, of aluminum oxide on the metalized piezoelectric layer. Alternatively, the actuator membrane may be zirconium or quartz.

The piezoelectric layer 76 can be attached to the actuator membrane 70 by a bonding layer 72. The bonding layer 72 may be a layer of amorphous silicon deposited onto the metal layer 74, which is then anodically bonded to the actuator membrane 70. In anodic bonding, the silicon substrate is heated while in contact with the glass while a negative voltage is applied to the glass. Ions drift toward the negative electrode, forming a depletion region in the glass at the silicon interface, which forms an electrostatic bond between the glass and silicon. The bonding layer may also be a metal that is soldered or forms a eutectic bond. Alternatively, the bonding layer can be an organic adhesive layer. Because the piezoelectric material has been previously fired, the adhesive layer is not subject to high temperatures during assembly. Organic adhesives of relatively low melting temperatures can also be used. An example of an organic adhesive is BCB resin available from Dow Chemical, Midland, Mich. The adhesive can be applied by spin-on processing to a thickness of e.g. about 0.3 to 3 micron. The actuator membrane can be bonded to the module substrate before or after the piezoelectric layer is bonded to the actuator membrane.

The actuator membrane 70 may be bonded to the module substrate 26 by adhesive or by anodic bonding. Anodic bonding is preferred because no adhesive contacts the module substrate features adjacent the flow path and thus the likelihood of contamination is reduced and thickness uniformity and alignment may be improved. The actuator substrate may be ground to a desired thickness after attachment to the module substrate. In other embodiments, the actuator does not include a membrane between the piezoelectric layer and the pumping chamber. The piezoelectric layer may be directly exposed to the ink chamber. In this case, both the drive and ground electrodes can be placed on the opposite, back side of the piezoelectric layer not exposed to the ink chamber.

Referring back to FIG. 2B, as well as FIGS. 4A and 4B, the actuators on either side of the centerline of the module are separated by cut lines 18, 18' which have a depth extending to the actuator membrane 70. For an actuator membrane 70 made of a transparent material such as glass, the nozzle flow path is visible through the cut lines, which permits analysis of ink flow, e.g. using strobe photography. Adjacent actuators are separated by isolation cuts 19. The isolation cuts extend (e.g. 1 micron deep, about 10 micron wide) into the silicon body substrate (FIG. 4B). The isolation cuts 19 mechanically isolate adjacent chambers to reduce crosstalk. If desired, the cuts can extend deeper into the silicon, e.g. to the depth of the pumping chambers. The back portion 16 of the actuator also includes ground contacts 13, which are separated from the actuators by separation cuts 14 extending into the piezoelectric layer leaving the ground electrode layer 72 intact (FIG. 4A). An edge cut 27 made before the top surface is metalized exposes the ground electrode layer 72 at the edge of the module so that the top surface metallization connects the ground contacts to the ground layer 72.

Manufacture

Figure 8A:
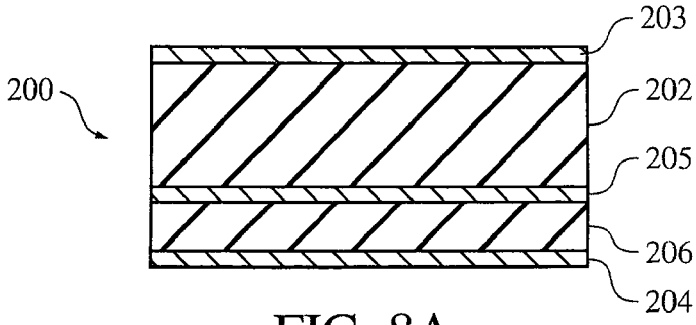
FIGS. 8A-8N are cross-sectional views illustrating manufacture of a printhead module body.
Figure 8B:
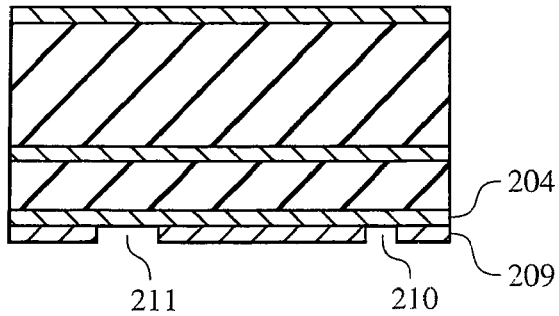
Figure 8C:
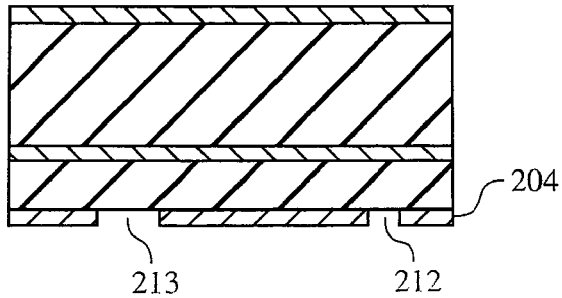
Figure 8D:
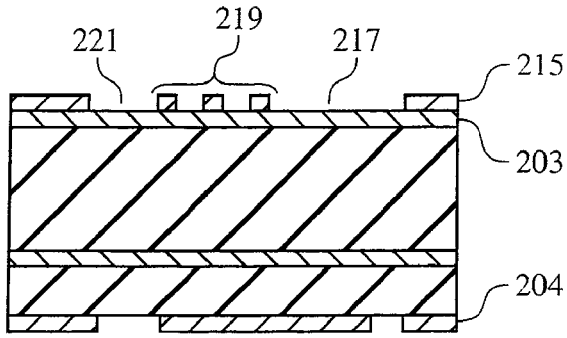
Figure 8E:
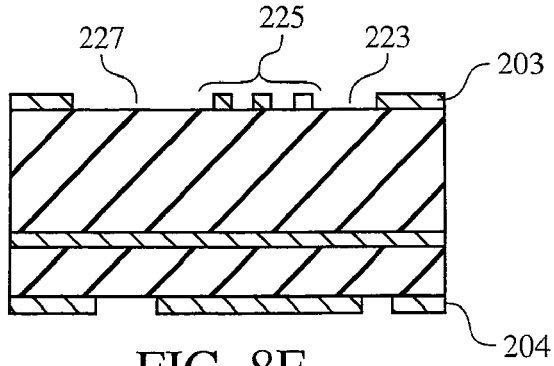
Figure 8F:
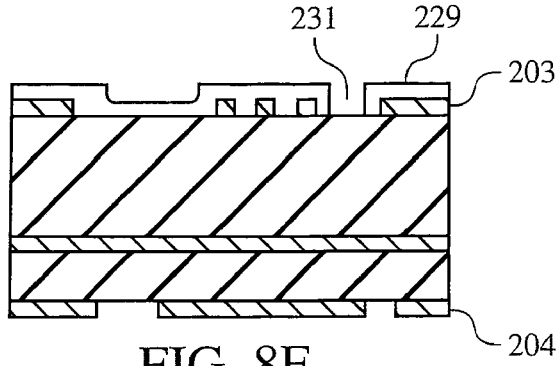
Figure 8G:
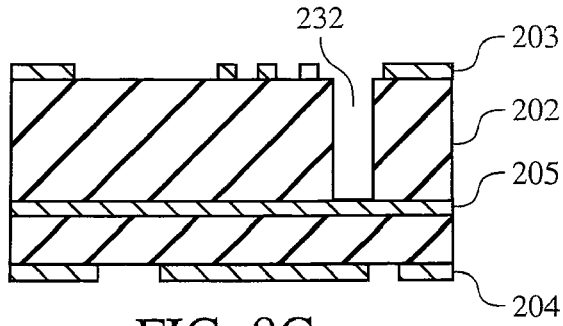
Figure 8H:
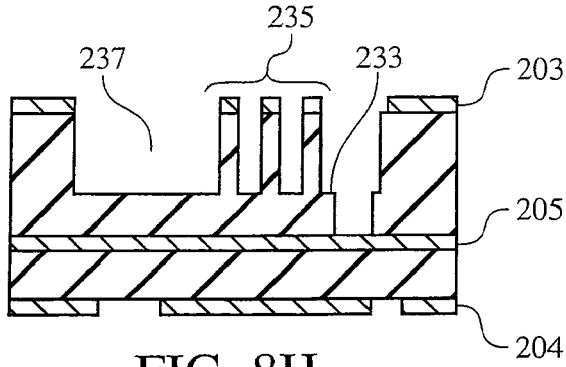
Figure 8I:
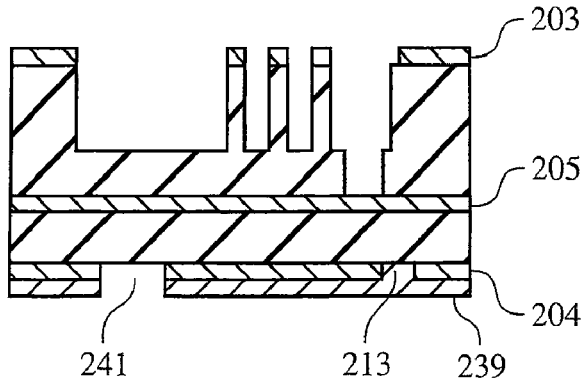
Figure 8J:
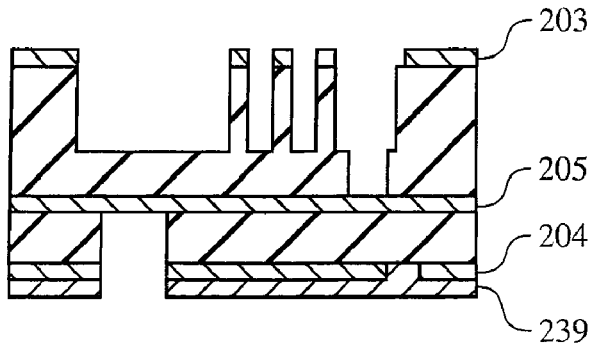
Figure 8K:
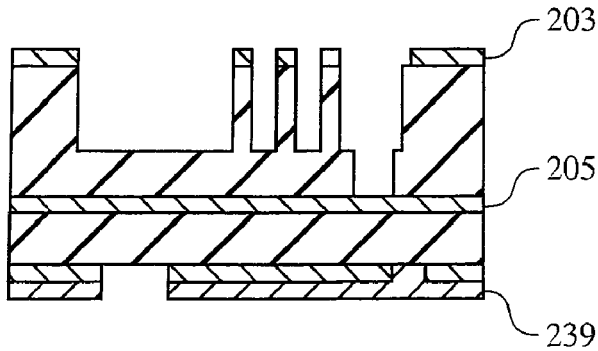
Figure 8L:
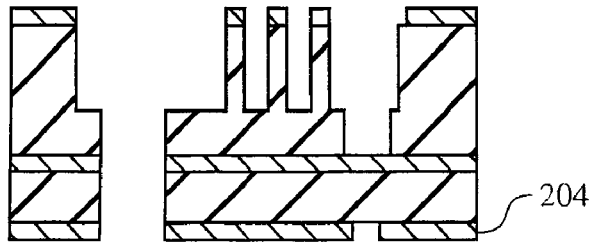
Figure 8M:
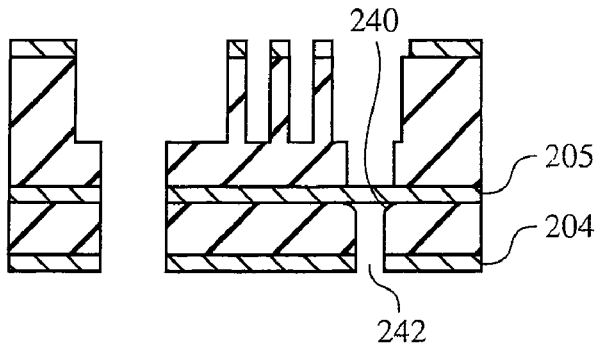
Figure 8N:
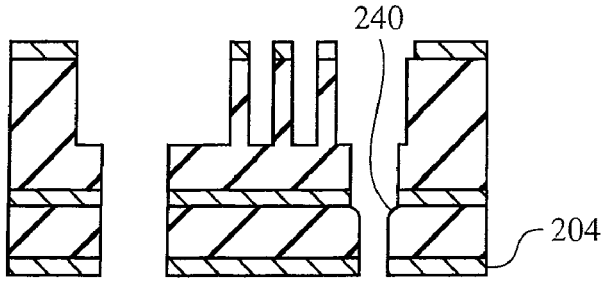

Referring to FIGS. 8A to 8N, manufacture of a module substrate is illustrated. A plurality of module substrates can be formed simultaneously on a wafer. For clarity, FIGS. 8A-8N illustrate a single flow path. The flow path features in the module substrate can be formed by etching processes. A particular process is isotropic dry etching by deep reactive ion etching which utilizes a plasma to selectively etch silicon or silicon dioxide to form features with substantially vertical sidewalls. A reactive ion etching technique known as the Bosch process is discussed in Laermor et al. U.S. Pat. No. 5,501,893, the entire contents of which is incorporated hereby by reference. Deep silicon reactive ion etching equipment is available from STS, Redwood City, Calif., Alcatel, Plano, Tex., or Unaxis, Switzerland. SOI wafers having <100> crystal orientation are available from, and reactive ion etching can be conducted by, etching vendors including IMT, Santa Barbara, Calif.

Referring to FIG. 8A, a SIO wafer 200 includes a handle of silicon 202, a BOX layer of silicon oxide 205, and an active layer of silicon 206. The wafer has an oxide layer 203 on the back surface and an oxide layer 204 on the front surface. The oxide layers 203, 204 may be formed by thermal oxidation or deposited by a vapor deposition. The thickness of the oxide layers is typically about 0.1 to 1.0 micron.

Referring to FIG. 8B, the front side of the wafer is provided with a photoresist pattern defining a nozzle opening region 210 and ink supply region 211.

Referring to FIG. 8C, the front side of the wafer is etched to transfer to the oxide layer a pattern defining a nozzle opening area 212 and a supply area 213. The resist is then removed.

Referring to FIG. 8D, the back side of the wafer is provided with a photoresist pattern 215 defining a pumping chamber region 217, a filter region 219, and an ink supply path region 221.

Referring to FIG. 8E, the back side is then etched to transfer to the oxide layer 203 a pattern including a pumping chamber area 223, a filter area 225, and an ink supply path area 227.

Referring to FIG. 8F, a resist pattern 229 defining a descender region 231 is provided on the back side of the wafer.

Referring to FIG. 8G, the descender area 232 is etched into the handle 202. The etching may be conducted using reactive ion etching to selectively etch silicon while not substantially etching silicon dioxide. The etching proceeds toward the BOX layer 205. The etching is terminated slightly above the BOX layer so that subsequent etching steps (FIG. 8H) remove the remaining silicon to the BOX layer. The resist is then stripped from the back side of the wafer.

Referring to FIG. 8H, the pumping chamber area 233, filter area 235, and supply area 237 are etched into the back side of the wafer. Deep silicon reactive ion etching selectively etches silicon without substantially etching silicon dioxide.

Referring to FIG. 8I, a photoresist pattern 239 defining a supply region 241 is provided on the front side of the wafer. The photoresist fills and protects the nozzle area 213.

Referring to FIG. 8J, a supply area 241 is etched using reactive ion etching. The etching proceeds to the BOX layer 205.

Referring to FIG. 8K, the buried layer is etched from the supply region. The BOX layer may be etched with a wet acid etch that selectively etches the silicon dioxide in the BOX layer without substantially etching silicon or photoresist.

Referring to FIG. 8L, the supply area is further etched by reactive ion etching to create a through passage to the front of the wafer. The resist 239 is then stripped from the front side of the wafer. Prior to the etching illustrated in FIG. 8L, the back side of the wafer can be provided with a protective metal layer, e.g. chrome, by PVD. After the supply area is etched, the protective metal layer is removed by acid etching.

Referring to FIG. 8M, the accelerator region 242 of the nozzle is formed by reactive ion etching from the front side of the wafer to selectively etch silicon without substantially etching silicon dioxide. The etching proceeds in nozzle area 213 defined in the oxide layer 204 to the depth of the BOX layer 205. As a result, the length of the accelerator region is defined between the front surface of the wafer and the buried oxide layer. The reactive ion etching process can be continued for a period of time after the BOX layer 205 is reached to shape the transition 240 between the descender region and the accelerator region. In particular, continuing to apply the ion etching energy after the silicon has been etched to the BOX layer tends to increase the diameter of the accelerator region adjacent the BOX layer 205, creating a curvilinear shaped diametrical transition 240 in the accelerator region. Typically, the shaping is achieved by overetching by about 20%, i.e., etching is continued for a time corresponding to about 20% of the time it takes to reach the BOX layer. Diametric variations can also be created by varying the etching parameters, e.g. etch rate, as a function of the etch depth.

Referring to FIG. 8N, the portion of the BOX layer 205 at the interface of the descender region and the accelerator region is removed using a wet etch applied from the back side of the wafer, to create a passageway between the descender region and the accelerator region. In addition, the wet etch application may remove the oxide layer 203 on the back surface of the wafer. If desired, the oxide layer 204 on the front surface of the wafer can be similarly removed to expose single crystal silicon, which is typically more wettable and durable than silicon oxide.

Figure 9:
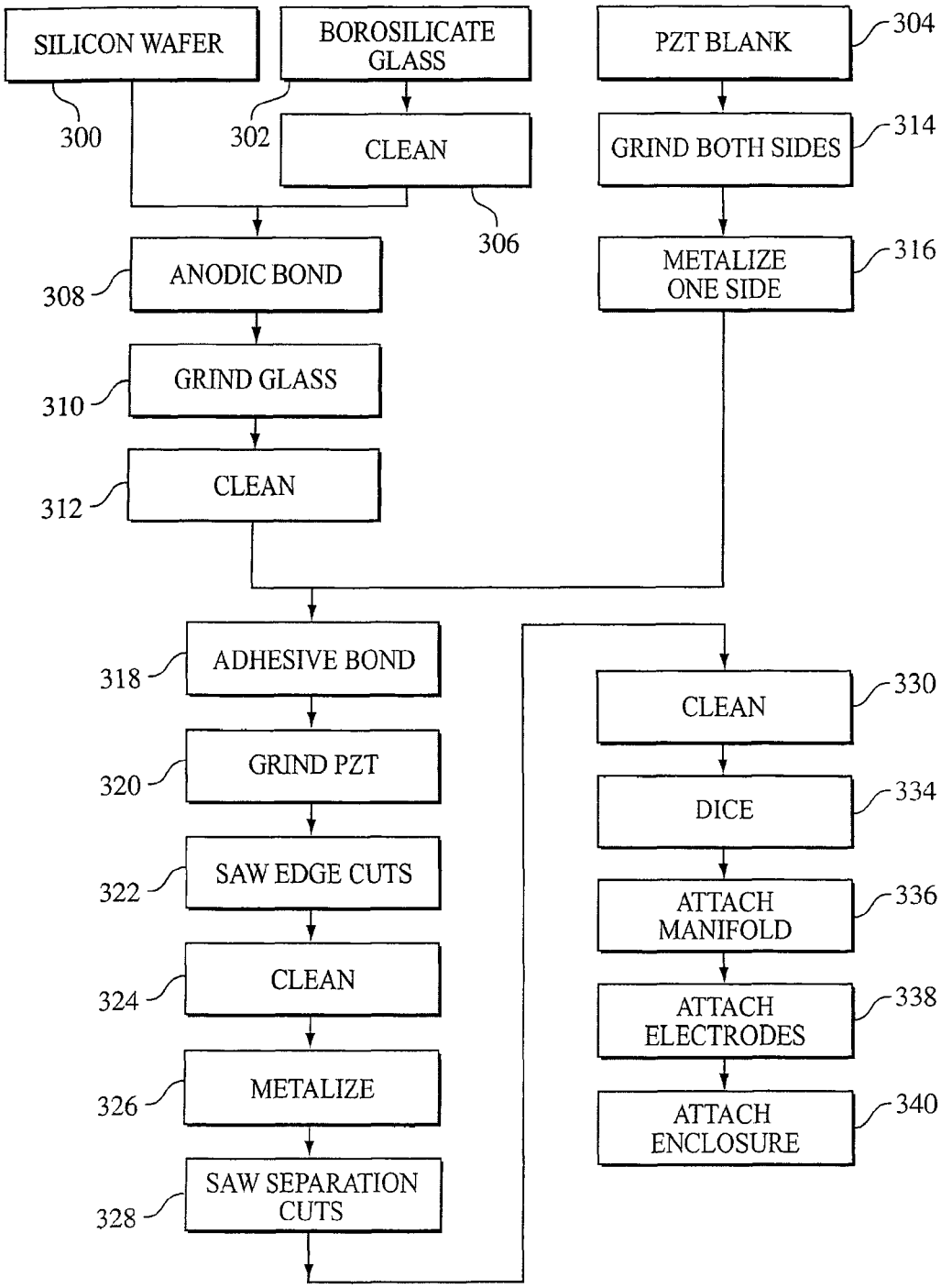
FIG. 9 is a flow diagram illustrating manufacture of a piezoelectric actuator and assembly of a module.

Referring now to FIG. 9, a flow diagram outlining manufacture of the actuator and assembly of the module is provided. In step 300, a silicon wafer including a plurality of modules with flow paths as illustrated in FIG. 8N is provided. In step 302, a blank of actuator substrate material, such as borosilicate glass is provided. In step 304, a blank of piezoelectric material is provided. In step 306, the actuator substrate material is cleaned, for example, using an ultrasonic cleaner with 1% Micro-90 cleaner. The glass blank is rinsed, dried with nitrogen gas and plasma etched. In step 308, the cleaned actuator substrate blank is anodically bonded to the etched silicon wafer provided in step 300. In step 310, the exposed surface of the actuator substrate blank is ground to a desired thickness and surface morphology using a precision grinding technique such as horizontal grinding. The front surface of the wafer may be protected by UV tape. The actuator substrate blank is typically provided in a relatively thick layer, for example, about 0.3 mm in thickness or more. The substrate blank can be accurately ground to a thickness of, e.g., about 20 microns. By bonding the actutuator substrate to the module substrate prior to grinding, warping or other damage to the thin membrane is reduced and dimensional uniformity is enhanced.

In step 312, the actuator substrate is cleaned. The actuator substrate may be cleaned in an ultrasonic bath and plasma etched as described above. In step 314, the piezoelectric blank is precision ground on both sides to provide smooth surface morphology. In step 316, one side of the piezoelectric blank is metalized. In step 318, the metalized side of the piezoelectric blank is bonded to the actuator substrate. The piezoelectric blank may be bonded using a spun on adhesive. Alternatively, a layer of amorphous silicon may be deposited on the metalized surface of the blank and the blank then anodically bonded to the actuator substrate.

Figure 10:
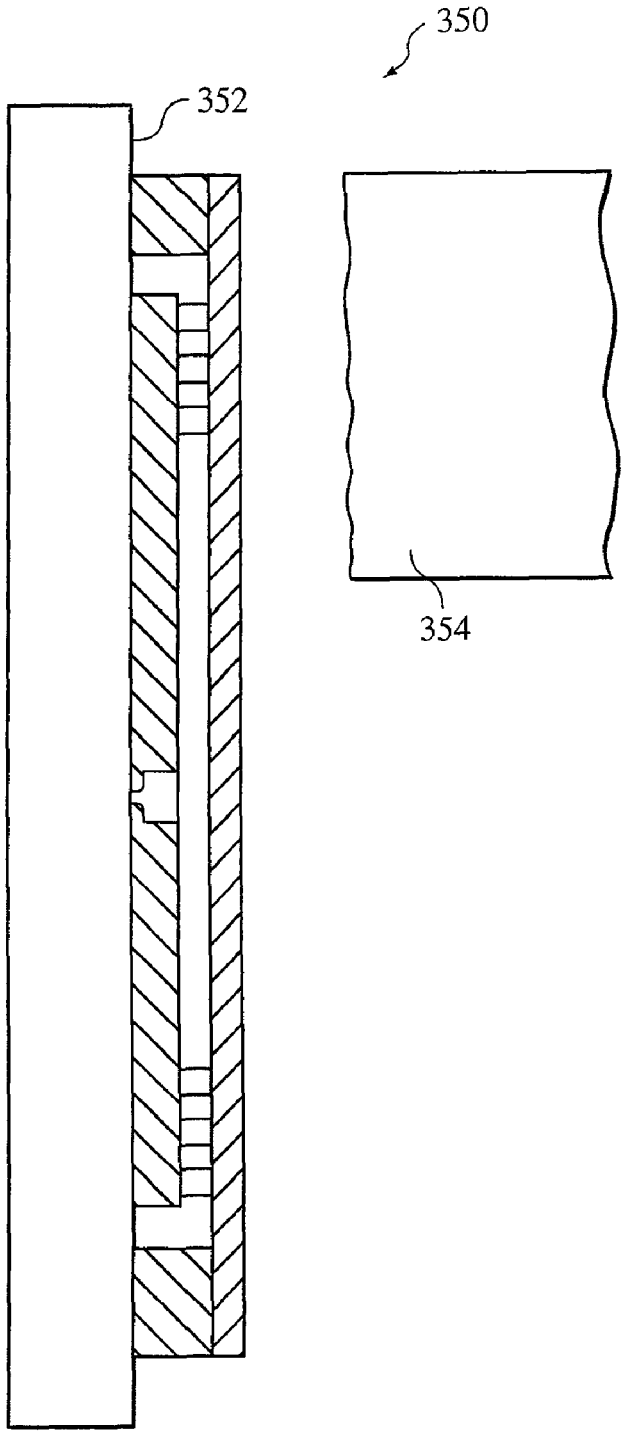
FIG. 10 is a cross-sectional side view illustrating grinding of a piezoelectric layer.

In step 320, the piezoelectric blank is ground to a desired thickness using a precision grinding technique. Referring as well to FIG. 10, the grinding is achieved using a horizontal grinder 350. In this process, the wafer is assembled to a chuck 352 having a reference surface machined to high flatness tolerance. The exposed surface of the piezoelectric blank is contacted with a rotating grinding wheel 354, also in alignment at high tolerance. The piezoelectric blank may have a substantial thickness, for example, about 0.2 mm or more, which can be handled for initial surface grinding in step 314. However, at the thicknesses desired for the actuator, for example, 50 microns or less, the piezoelectric layer can be easily damaged. To avoid damage and facilitate handling, the piezoelectric blank is ground to the desired thickness after it has been bonded to the actuator substrate. During grinding, the nozzle opening may be covered to seal the ink flow path from exposure to grinding coolant. The nozzle openings may be covered with tape. A dummy substrate can be applied to the chuck and ground to desired flatness. The wafer is then attached to the dummy substrate and ground to the parallelism of the dummy substrate.

In step 322, edge cuts for the ground electrode contacts are cut to expose the ground electrode layer 74. In step 324, the wafer is cleaned. In step 326, the backside of the wafer is metalized, which provides a metal contact to the ground layer, as well as provides a metal layer over the back surface of the actuator portion of the piezoelectric layer. In step 228, separation and isolation cuts are sawed. In step 330, the wafer is again cleaned.

In step 334, the modules are separated from the wafer by dicing. In step 336, the modules are attached to the manifold frame. In step 338, electrodes are attached. Finally, in step 340, the arrangement is attached to an enclosure.

The front face of the module may be provided with a protective coating and/or a coating that enhances or discourages ink wetting. The coating may be, e.g., a polymer such as Teflon or a metal such as gold or rhodium. A dicing saw can be used to separate module bodies from a wafer. Alternatively or in addition, kerfs can be formed by etching and separation cuts can be made in the kerfs using a dicing saw. The modules can also be separated manually by breaking along the kerfs.

Other Embodiments

Figure 11:
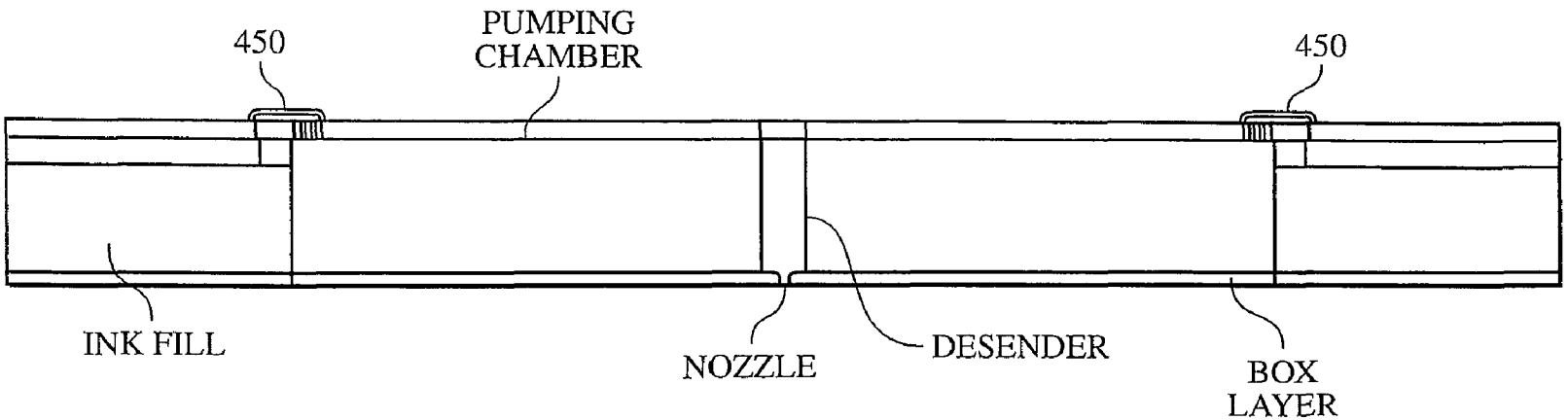
FIG. 11 is a cross-sectional view of a printhead module.

Referring to FIG. 11, a compliant membrane 450 is provided upstream of the pumping chamber, e.g. over filter/impedance feature and/or the ink supply flow path. A compliant membrane reduces crosstalk by absorbing acoustic energy. The compliant membrane may be provided by a continuous portion of the actuator substrate. This portion may be ground, sawed, or laser machined to reduced thickness (e.g. to about 2 micron) compared to the portion over the pumping chamber to enhance compliance. A compliant membrane may include a piezoelectric material layer or the piezoelectric material may be sized so as to not cover the membrane. The membrane may also be a separate element such as a polymer or silicon dioxide or silicon nitride film bonded to the module substrate. A compliant membrane along the front face of the module adjacent the ink supply flow path may be used in addition or in place of the membrane 450. Compliant membranes are discussed in Hoisington U.S. Pat. No. 4,891,054, the entire contents of which is incorporated herein by reference.

Figure 12A:
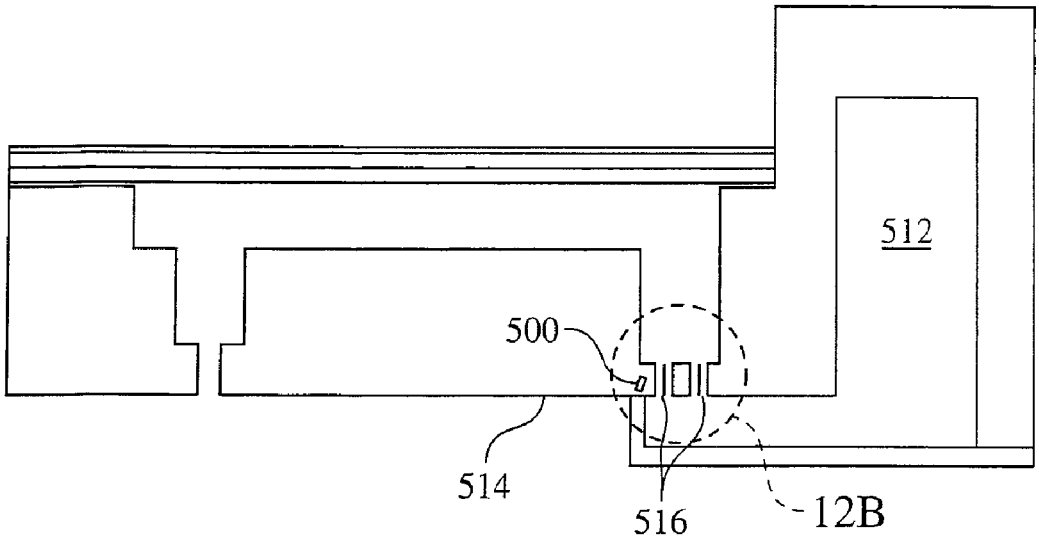
Figure 12B:
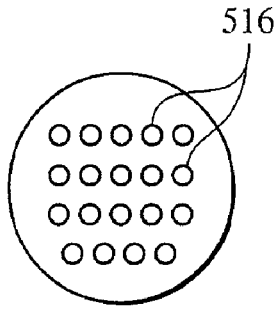
FIG. 12B is an enlarged view of a portion of the front surface of the module in region B in FIG. 12B.

Referring to FIGS. 12A and 12B, a filter/impedance control feature 500 is provided as a series of apertures formed in a wall member, in this case in the module substrate in the same layer defining nozzle/accelerator region. In this example, the ink is provided by a frame flow path 512 that leads to the bottom surface 514 of the module substrate. The bottom surface 514 has a series of apertures 516 sized to perform a filtering function and absorb acoustic energy.

Figure 13A:
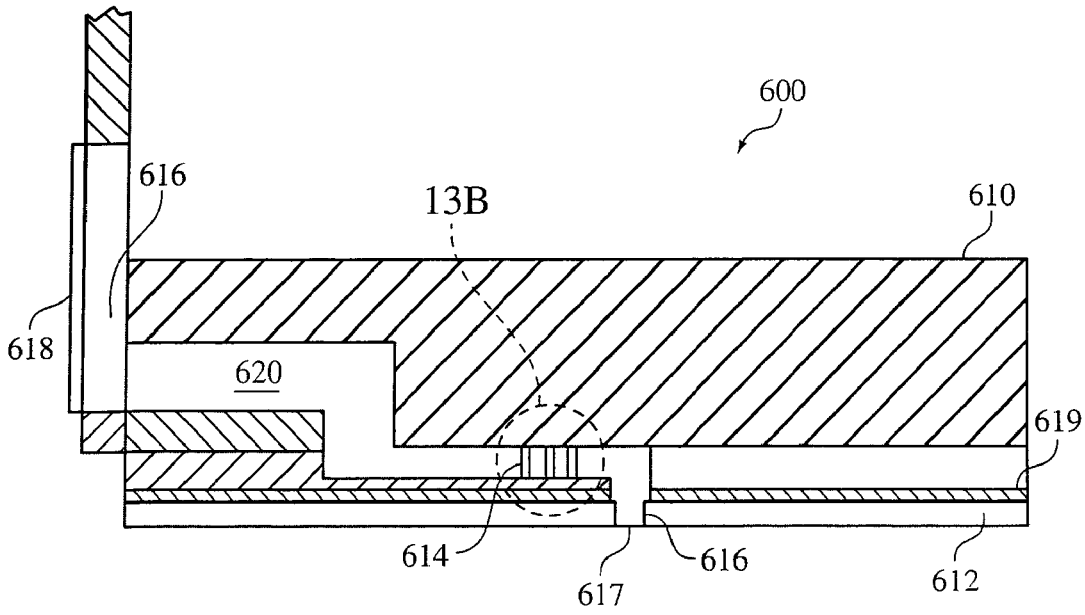
Figure 13B:
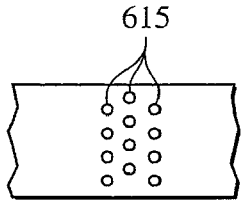
FIG. 13B is an enlarged top view of the region A in FIG. 13A.

Referring to FIGS. 13A and 13B, a printhead module 600 is provided with a substrate body 610 formed of e.g. carbon or metal and a nozzle plate 612 formed of semiconductor and having an impedance/filter feature 614. A pumping chamber 616 and an actuator 618 are in communication with the body 610. The substrate body 612 defines a nozzle flow path 620 which may be formed by grinding, sawing, drilling, or other non-chemical machining and/or assembling multiple pre-machined layers. The feature 614 of the nozzle plate is formed of a plurality of rows of posts 615 in the flow path leading to an accelerator region 616 and a nozzle opening 617. The nozzle plate 612 may be formed by etching a SOI wafer including a BOX layer 619 to provide high uniformity in the accelerator portion of the flow path. The nozzle plate 612 may be bonded to the body 610 by, e.g., an adhesive.

Figure 14A:
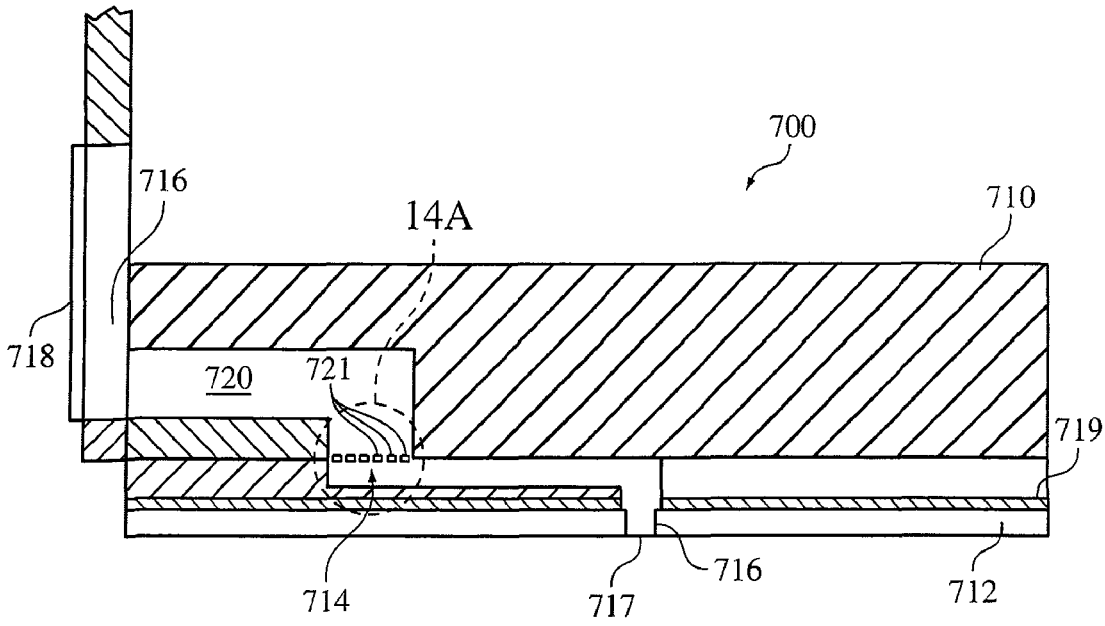
Figure 14B:
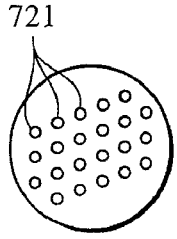
FIG. 14B is an enlarged top view of the region A in FIG. 14A.

Referring to FIGS. 14A and 14B, a printhead module 700 is provided with a substrate body 710 formed, e.g. of carbon or metal, and a nozzle plate 712 formed of silicon and having an impedance/filter feature 714. A pumping chamber 716 and an actuator 718 are in communication with the body 710. The carbon substrate body 712 defines a nozzle flow path 720. The feature 714 is formed on the back surface of the nozzle plate and includes a plurality of apertures 721. The nozzle plate 712 may be formed by etching a SOI wafer including a BOX layer 719 to provide high uniformity to the accelerator portion of the flow path. The nozzle plate 712 may be bonded to the body 710 by e.g. an adhesive.

Figure 15A:
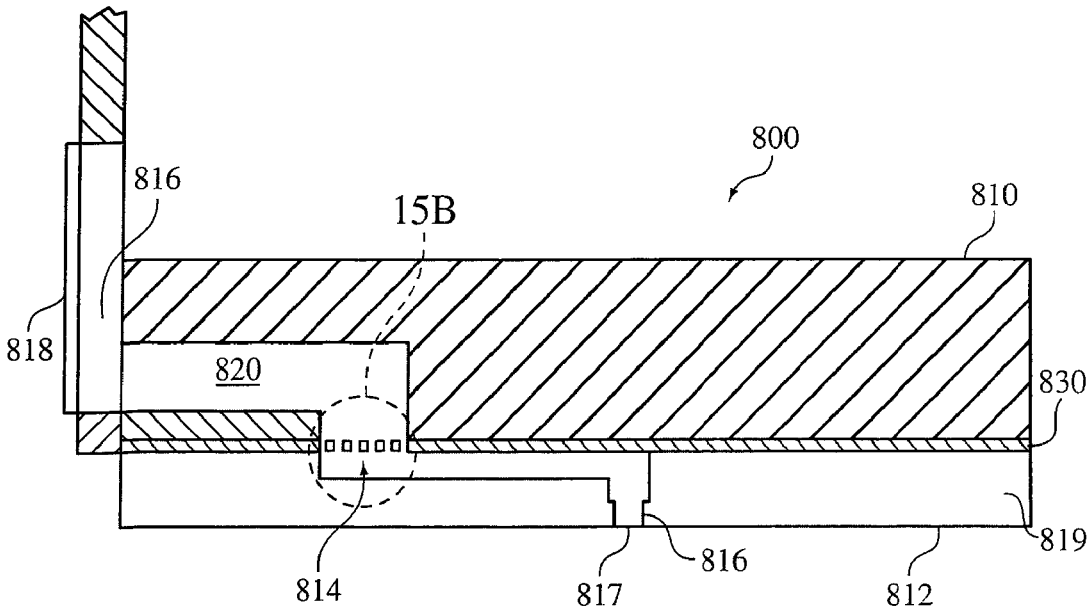
Figure 15B:
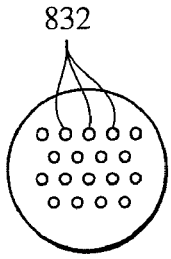
FIG. 15B is an enlarged top view of region A in FIG. 15A.

Referring to FIGS. 15A and 15B, a printhead module 800 is provided with a substrate body 810 formed e.g. of carbon or metal, a nozzle plate 812 formed of e.g. metal or silicon and an impedance/filter feature 814 defined in a layer 830 formed of silicon. A pumping chamber 816 and an actuator 818 are in communication with the body 810. The body 812 defines a nozzle flow path 820. The feature 814 has a plurality of apertures 821. The nozzle plate 812 and the layer 830 may be formed by etching a SOI wafer including a BOX. The element 830 is located between the body 810 and nozzle plate 812. The element 830 can be bonded to the body 810 and the nozzle plate 812 can be bonded to the element 830 using, e.g., an adhesive.

Figure 16A:
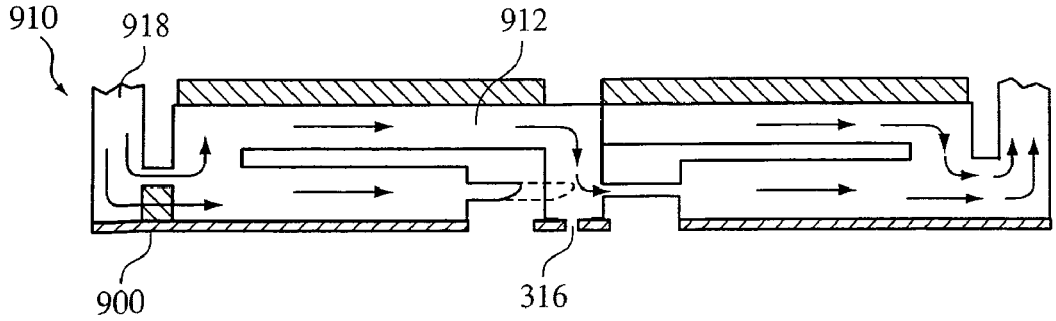
Figure 16B:
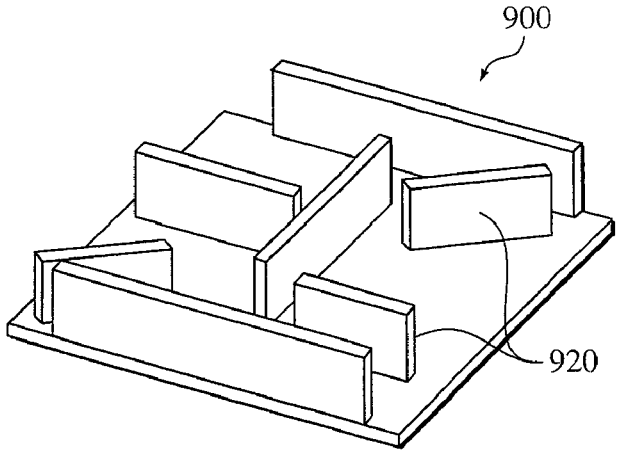
FIG. 16B is a perspective view of a component of the module.

Referring to FIGS. 16A and 16B, a semiconductor filter/impedance control element 900 is provided as a separate element in a module 910. The module body defines a pressure chamber 912 and can be constructed of a plurality of assembled layers as discussed in Hoisington, U.S. Pat. No. 4,891,654, contents incorporated supra. The element 900 is positioned near an ink inlet 918 upstream of the chamber 912. In this embodiment, the filter/impedance control element is formed as a series of thin rectangular projections 920 positioned at angles to provide a maze-like path along the ink flow direction. The projections can be formed by etching a semiconductor substrate.

In other embodiments, the etched module body or nozzle plates described above can be utilized with actuator mechanisms other than piezoelectric actuators. For example, thermal bubble jet or electrostatic actuators can be used. An example of an electrostatic actuator can be found in U.S. Pat. No. 4,386,358, the entire contents of which is incorporated herein by reference. Other etchable materials can be used for the module substrate, nozzle plates, and impedance/filter features, for example, germanium, doped silicon, and other semiconductors. Stop layers can be used to define thicknesses of various features, such as the depth, uniformity, and shape the pumping chamber. Multiple stop layers can be provided to control the depth of multiple features.

The piezoelectric actuators described above can be utilized with other module substrates and substrate systems. Piezoelectric layers formed of piezoelectric material that has not been prefired can be used. For example, a thin piezoelectric film can be formed on a glass or silicon substrate by techniques, such as sol gel deposition or a green sheet technique and subsequently fired. The surface characteristics and/or thickness can be modified by precision grinding. The high temperature resistance of these actuator substrate materials can withstand the firing temperatures of the ceramic precursors. While a three-layer SOI substrate is preferred, semiconductor substrates having two layers of differentially-etchable semiconductor material, such as a layer of silicon oxide on silicon, can be used to form module body substrates or nozzle plates and control feature depths by differential etching. For example, a monolithic body of silicon oxide on silicon can be used. An accelerator region can be defined between a nozzle opening on the silicon face of a substrate and the interface between the silicon and silicon oxide layer.

Use

The printhead modules can be used in any printing application, particularly high speed, high performance printing. The modules are particularly useful in wide format printing in which wide substrates are printed by long modules and/or multiple modules arranged in arrays.

Referring back to FIGS. 1 to 1C, to maintain alignment among modules within the printer, the faceplate 82 and the enclosure 86 are provided with respective alignment features 85, 89. After attaching the module to the faceplate 82, the alignment feature 85 is trimmed, e.g., with a YAG laser or dicing saw. The alignment feature is trimmed utilizing an optical positioner and the feature 85 is aligned with the nozzle openings. The mating alignment features 89 on the enclosure 86 are aligned with each other, again, utilizing laser trimming or dicing and optical alignment. The alignment of the features is accurate to ±1 μm or better. The faceplate can be formed of, e.g., liquid crystal polymer. Suitable dicing saws include wafer dicing saws e.g. Model 250 Integrated Dicing Saw and CCD Optical Alignment System, from Manufacturing Technology Incorporated, Ventura, Calif.

The modules can be used in printers for offset printing replacement. The modules can be used to selectively deposit glossy clear coats applied to printed material or printing substrates. The printheads and modules can be used to dispense or deposit various fluids, including non-image forming fluids. For example, three-dimensional model pastes can be selectively deposited to build models. Biological samples may be deposited on an analysis array.

Still further embodiments are in the following claims.

What is claimed is:

1. A printhead comprising:

a body including a flow path; and;

a piezoelectric actuator having a piezoelectric layer fixed to the body;

wherein the body comprises a pumping chamber below the actuator and an impedance feature in the flow path upstream of the pumping chamber, wherein the impedance feature comprises a first plurality of posts arranged in a first row within the flow path, at least one post in the first row of posts having a downstream surface that is concave and an upstream surface that is convex, and a second plurality of posts arranged in a second row within the flow path, at least one post in the second row of posts having a downstream surface that is convex and an upstream surface that is concave.

2. The printhead of claim 1, wherein the piezoelectric layer includes lead oxide.

3. The printhead of claim 1, wherein the piezoelectric layer has a thickness of less than 50 μm and a $d_{31}$ coefficient of $200*10^{-12}$C/N or more.

4. The printhead of claim 3, wherein the piezoelectric layer has a thickness of 25 μm or less.

5. The printhead of claim 1, wherein the piezoelectric actuator includes an actuator substrate and the actuator substrate has a thickness of 50 μm or less.

6. The printhead of claim 1, wherein the body comprises a modular substrate adjacent to the flow path and the piezoelectric actuator, the modular substrate being spaced apart by a spacing comprising the flow path, the flow path having a varying cross-section and the modular substrate comprising a buried layer disposed between at least two of the other layers of the modular substrate having different spacings.

7. The printhead of claim 1, wherein the body defines a nozzle opening downstream of the pumping chamber, and wherein the impedance feature has a lower flow resistance than the nozzle opening.

8. The printhead of claim 1, wherein the first and second pluralities of posts include a plurality of rows of posts.

9. The printhead of claim 8, each row of posts is offset from an adjacent row of posts.

10. The printhead of claim 1, wherein the first and second pluralities of posts are formed by deep silicon reactive ion etching.

11. A printhead comprising:

a body including a flow path; and;

a piezoelectric actuator having a piezoelectric layer fixed to the body;

wherein the body comprises a pumping chamber below the actuator and an impedance feature in the flow path upstream of the pumping chamber, wherein the impedance feature comprises a plurality of posts arranged in at least one row, at least one post in the at least one row of posts having a downstream surface that is concave, wherein the body defines a nozzle opening downstream of the pumping chamber, wherein the impedance feature has a plurality of flow openings, and wherein a cross-sectional area of each of the flow openings is less than a cross-sectional area of the nozzle opening and a sum of the areas of the flow openings is greater than the area of the nozzle opening.

12. The printhead of claim 11 wherein the cross-sectional area of each of the flow openings is about 60% or less of the cross-sectional area of the nozzle opening.

13. The printhead of claim 12 wherein the sum of the areas of the flow openings is about 2 or more times the cross-sectional area of the nozzle opening.

* * * * *